US008398169B2

(12) United States Patent
LaPointe

(10) Patent No.: US 8,398,169 B2
(45) Date of Patent: Mar. 19, 2013

(54) FURNITURE MEMBER HAVING POWERED GLIDING MOTION

(75) Inventor: Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 53 days.

(21) Appl. No.: 13/076,516

(22) Filed: Mar. 31, 2011

(65) Prior Publication Data

US 2011/0248536 A1 Oct. 13, 2011

Related U.S. Application Data

(63) Continuation-in-part of application No. 12/759,267, filed on Apr. 13, 2010.

(51) Int. Cl.
*A47C 3/02* (2006.01)

(52) U.S. Cl. ..... 297/260.2; 297/270.1; 297/85 M; 297/DIG. 7

(58) Field of Classification Search ..... 297/85 M, 297/259.2, DIG. 7, 260.2, 270.1; 70/278.7
See application file for complete search history.

(56) References Cited

U.S. PATENT DOCUMENTS

| | | | | | |
|---|---|---|---|---|---|
| 2,302,387 | A | | 11/1942 | Greeno et al. | |
| 2,683,481 | A | | 7/1954 | Lorenz | |
| 2,841,802 | A | * | 7/1958 | Leverett | 5/109 |
| 3,022,520 | A | * | 2/1962 | Finger | 5/109 |
| 4,154,475 | A | | 5/1979 | Shoemaker et al. | |
| 4,536,029 | A | | 8/1985 | Rogers | |
| 4,544,201 | A | * | 10/1985 | Rogers, Jr. | 297/259.2 |
| 4,591,205 | A | | 5/1986 | James | |
| 4,674,794 | A | * | 6/1987 | Pine | 297/85 M |
| 4,681,365 | A | * | 7/1987 | Pine | 297/85 M |
| 4,700,920 | A | | 10/1987 | Horn | |
| 4,911,499 | A | * | 3/1990 | Meeker | 297/260.2 |
| 5,014,960 | A | * | 5/1991 | Kimura | 248/602 |
| 5,107,555 | A | * | 4/1992 | Thrasher | 5/109 |
| 5,326,153 | A | | 7/1994 | Muffi | |
| 5,342,113 | A | * | 8/1994 | Wu | 297/260.2 |
| 5,427,433 | A | | 6/1995 | Holobaugh, Jr. | |
| 5,572,903 | A | * | 11/1996 | Lee | 74/44 |
| 5,730,494 | A | * | 3/1998 | LaPointe et al. | 297/330 |
| 5,765,913 | A | | 6/1998 | LaPointe et al. | |
| 5,795,021 | A | * | 8/1998 | Rogers | 297/281 |
| 5,795,028 | A | | 8/1998 | Dussia, Jr. et al. | |
| 5,845,350 | A | * | 12/1998 | Beemiller et al. | 5/109 |
| 5,857,744 | A | | 1/1999 | LaPointe et al. | |
| 5,890,765 | A | | 4/1999 | LaPointe et al. | |
| 5,992,931 | A | | 11/1999 | LaPointe et al. | |
| 6,068,566 | A | * | 5/2000 | Kim | 474/84 |
| 6,152,529 | A | * | 11/2000 | Beason | 297/260.2 |
| 6,584,817 | B1 | * | 7/2003 | Lien | 70/277 |
| 6,810,700 | B2 | * | 11/2004 | Okuno | 70/186 |
| 7,828,756 | B2 | * | 11/2010 | Kamba et al. | 601/98 |
| 2002/0140263 | A1 | * | 10/2002 | Sato et al. | 297/260.1 |

(Continued)

*Primary Examiner* — David Dunn
*Assistant Examiner* — David E Allred
(74) *Attorney, Agent, or Firm* — Harness, Dickey & Pierce, P.L.C.

(57) ABSTRACT

A furniture member having a powered gliding motion includes a frame having a plurality of upright posts. Individual ones of a plurality of links are individually rotatably connected to individual ones of the upright posts. An actuation mechanism is suspended from the upright posts at rotatably connected free ends of each of the links to permit forward and rearward gliding motions of the actuation mechanism. The actuation mechanism includes a leg rest assembly movable between a fully retracted and a fully extended position. A powered glider drive assembly selectively connected to both the frame and the actuation mechanism successively moves the actuation mechanism in the forward gliding motion and the rearward gliding motion independent of the position of the leg rest assembly.

20 Claims, 34 Drawing Sheets

U.S. PATENT DOCUMENTS

2010/0052376 A1* 3/2010 Hopke et al. ..... 297/188.01
2010/0052387 A1* 3/2010 Hopke et al. ..... 297/260.2
2011/0049963 A1* 3/2011 Shih ..... 297/85 M
2011/0248545 A1* 10/2011 LaPointe et al. ..... 297/85 M
2011/0248547 A1* 10/2011 LaPointe et al. ..... 297/85 R

* cited by examiner

FURNITURE MEMBER HAVING POWERED GLIDING MOTION

CROSS-REFERENCE TO RELATED APPLICATIONS

This application is a continuation-in-part of U.S. patent application Ser. No. 12/759,267 filed on Apr. 13, 2010. The entire disclosure of the above application is incorporated herein by reference.

FIELD

The present disclosure relates to furniture members having forward and rearward gliding capability.

BACKGROUND

This section provides background information related to the present disclosure which is not necessarily prior art.

Conventionally, reclining articles of furniture (i.e., chairs, sofas, loveseats, and the like) require a mechanism to bias a leg rest assembly in the extended and stowed positions and to move a seat back member from an upright to a fully reclined position. Most reclining furniture members include an upholstered frame supported from a stationary base assembly. For example, known combination platform reclining chairs permit reclining movement of the seat assembly and actuation of the leg rest assembly independently of the seat back member. The leg rest assembly is operably coupled to a drive mechanism to permit the seat occupant to selectively move the leg rest assembly between its normally retracted (i.e., "stowed") and elevated (i.e., "extended") positions. The drive mechanism is manually-operated and includes a handle which, when rotated by the seat occupant, causes concurrent rotation of a drive rod for extending or retracting the leg rest assembly.

Furniture member mechanisms are known which suspend the mechanism from posts upwardly extending from a base frame using elongated linkage members so the mechanism and thereby the furniture member can "glide" forward and backward from a neutral position by force induced by the furniture member occupant. The gliding motion is distinct from "rocking" mechanisms in that in rocking mechanisms a biasing device or assembly on opposite sides of the furniture member positioned between a frame member and the mechanism directly supports the mechanism from below the mechanism. This substantially limits forward and rearward motion with respect to an axis of rotation defined by the biasing device. Because of the length of the supporting linkage members, the "glide" mechanism provides increased forward and rearward displacement compared to the rocking mechanism.

SUMMARY

This section provides a general summary of the disclosure, and is not a comprehensive disclosure of its full scope or all of its features.

According to several embodiments of the present disclosure, a furniture member having a powered gliding motion includes a frame. An actuation mechanism movably connected to the frame permits forward and rearward gliding motions of the actuation mechanism. A powered glider drive device releasably connects the frame and the actuation mechanism and operates to automatically move the actuation mechanism in the forward and rearward gliding motions.

According to further embodiments, a furniture member having a powered gliding motion includes a frame including a plurality of upright posts. A plurality of links are individually rotatably connected to individual ones of the plurality of upright posts. An actuation mechanism is suspended from the upright posts at rotatably connected free ends of each of the links permitting forward and rearward gliding motions of the actuation mechanism. The actuation mechanism includes a leg rest assembly movable between a fully retracted and a fully extended position inclusive. A powered glider drive assembly connected to both the frame and the actuation mechanism operates to successively move the actuation mechanism in the forward gliding motion and the rearward gliding motion independent of the position of the leg rest assembly.

According to other embodiments, a furniture member having a powered gliding motion includes a frame. An actuation mechanism movably connected to the frame permits forward and rearward gliding motions of the actuation mechanism. A powered glider drive device is selectively connected to both the frame and the actuation mechanism having a gliding motion motor connected to and operating a power transfer device to automatically move the actuation mechanism in the forward and rearward gliding motions. A drive shaft is connected to the gliding motion motor and is movable in a forward and a rearward direction by operation of the gliding motion motor. The powered glider drive device further includes a solenoid and a pin movable by the solenoid to releasably engage a slot created in the drive shaft to selectively movably connect the actuation mechanism to the frame.

According to still further embodiments, a furniture member having a powered gliding motion includes a frame. An actuation mechanism movably connected to the frame permits forward and rearward gliding motions of the actuation mechanism. A powered glider drive device selectively connected to both the frame and the actuation mechanism has a gliding motion motor operating a power transfer device to automatically move the actuation mechanism in the forward and rearward gliding motions. A drive shaft is connected to the power transfer device and is movable in a forward and a rearward direction by operation of the gliding motion motor. The actuation mechanism further includes a leg rest assembly; a seat back member; and an electrically powered drive assembly operating to rotate the leg rest assembly and the seat back member independently of the forward and rearward gliding motions.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
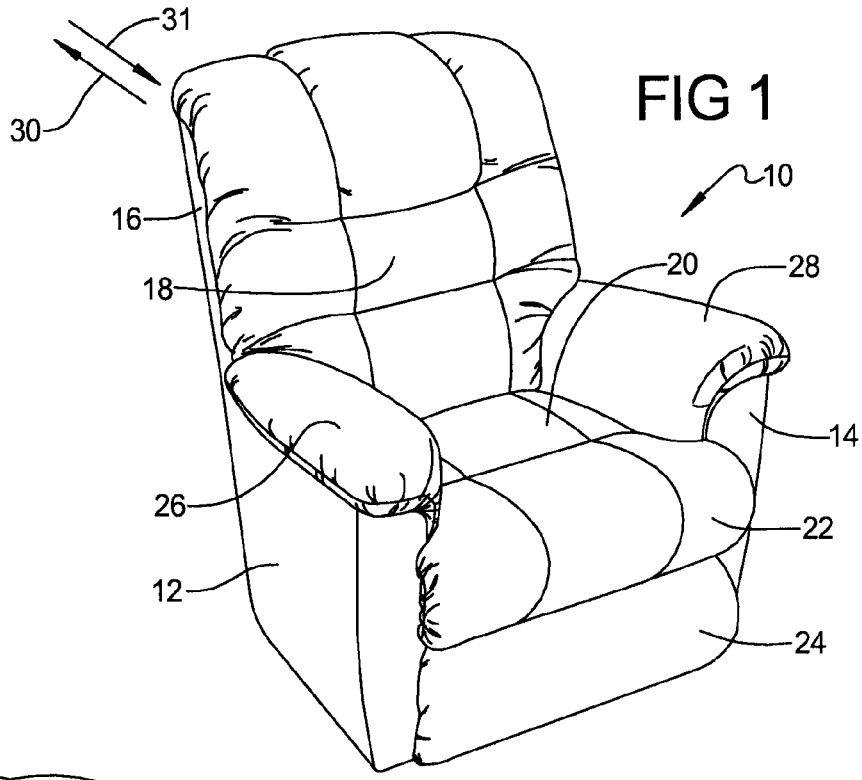
FIG. 1 is a front right perspective view of a power actuated glider furniture member of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring generally to FIG. 1, a furniture member 10 depicted as a chair includes first and second sides 12, 14 and an occupant seat back 16 covered with a seat back cushion assembly 18. An occupant support member 20 is suspended between the first and second sides 12, 14 and a padded leg support 22 is also provided. A padded, extendable leg rest assembly 24 is also provided. First and second arm rest pads 26, 28 can be used to cover the upper surfaces of the first and second sides 12, 14 respectively. From the leg rest assembly 24 stowed or retracted position shown, seat back 16 is powered to recline or rotate with respect to a seat back recline arc of rotation 30. Seat back 16 rotates about a seat back reclining arc of rotation 30 only after leg rest assembly 24 reaches a fully extended position shown and described with reference to FIGS. 8 and 11. Seat back 16 returns to the upright position shown about a seat back forward arc of rotation 31 directed opposite to seat back reclining arc of rotation 30 when a command is given by the occupant. Thereafter, the seat back 16 first rotates back to the upright position sequentially followed by return of leg rest assembly 24 from a fully extended position to the fully retracted position shown. In the embodiment shown, furniture member 10 is depicted as a chair however the present teachings are not limited to chairs. Furniture member 10 can also be any of a plurality of furniture members, including, but not limited to single or multiple person furniture members, sofas, sectional members and/or loveseats.

Figure 2:
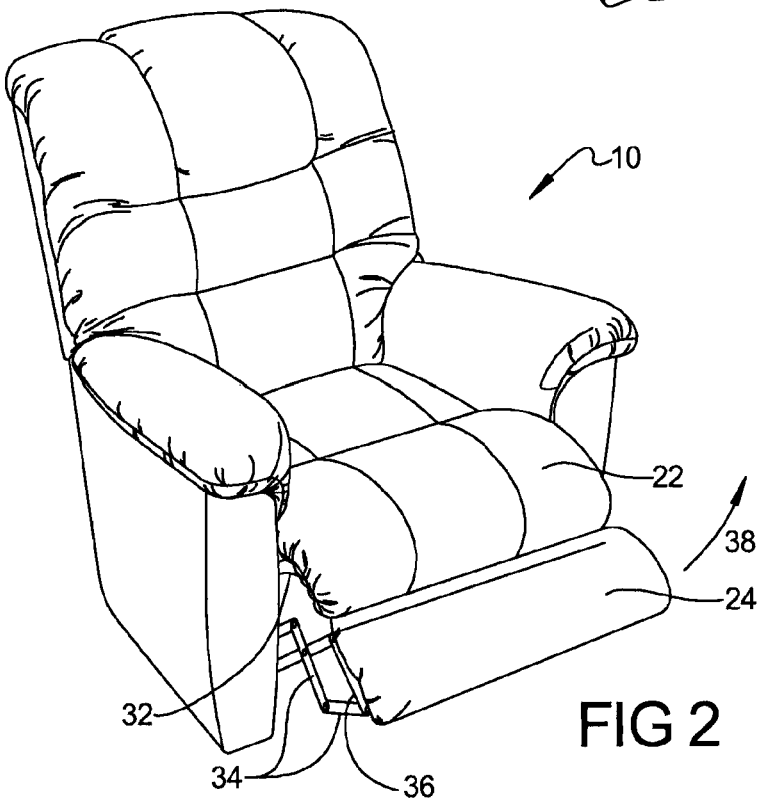
FIG. 2 is the front right perspective view of FIG. 1 further showing a leg rest assembly in an extended position.

Referring generally to FIG. 2 and again to FIG. 1, an actuation mechanism 32 (shown only partially in this view) can be actuated by the occupant to direct the repositioning of leg rest assembly 24 from the stowed position (shown in FIG. 1) to an extended position (a partially extended position is shown). Actuation mechanism 32 supports and permits both extension and retraction of leg rest assembly 24, as well as rotation of seat back 16. More specifically, actuation mechanism 32 includes first and second pantograph linkage sets 34, 35 (second pantograph linkage set 35 is not visible in this view) which are linked to leg rest assembly 24 using first and second leg rest support arms 36, 37 (only first leg rest support arm 36 is visible in this view). Leg rest assembly 24 can be moved from the fully retracted position (shown in FIG. 1) to the extended position by motion of the leg rest assembly 24 about a leg rest extension arc 38. It will be apparent that rotation of leg rest assembly 24 in an opposite direction from extension arc 38 will return the leg rest assembly 24 to the retracted position.

Figure 3:
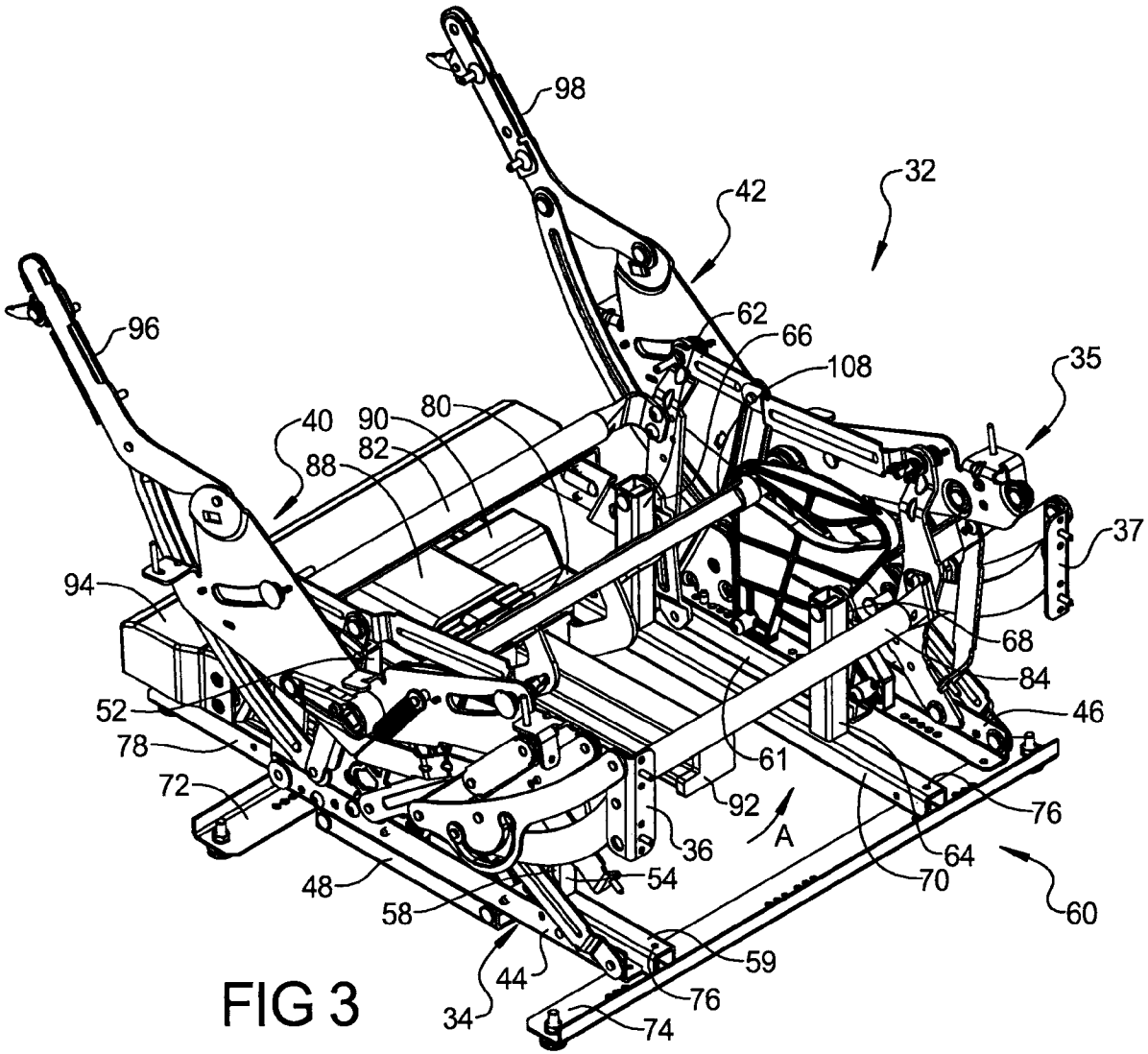
FIG. 3 is a right front perspective view of a glider mechanism of the present disclosure.

Referring to FIG. 3, the functional and structural aspects of actuation mechanism 32 for use in either single or multi-person furniture members 10 is shown. For purposes of clarity, FIG. 3 shows the various pre-assembled frame components with their upholstery, padding, etc. removed to better illustrate the interdependency of the mechanism components' construction which can be rapidly and efficiently assembled. Therefore, all of the mechanism components can be individually fabricated or sub-assembled to include the requisite brackets, springs, padding and upholstery on an "off-line" batch-type basis. Thereafter, the various pre-assembled and upholstered furniture components are assembled for totally integrating actuation mechanism 32 therein.

As generally used herein, the terms front or forward and right hand or left hand are oriented with respect to the direction an occupant of the furniture member 10 faces when seated or with respect to the occupant's sides when the occupant is seated. The terms rear or rearward refer to a direction opposite to the front or forward direction. A linkage portion of actuation mechanism 32 includes right and left side assemblies 40, 42, which are fixedly connected to and supported by right and left side support members 44, 46. Right and left side support members 44, 46 are individually connected to a first or second support structure 48, 50. First support structure 48 is rotatably linked to first and second posts 52, 54 by first and second glide links 56, 58 (only second glide link 58 is partially visible in this view). First and second posts 52, 54 are each fixed to a first longitudinal frame member 59 of a frame assembly 60 which supports all the components of actuation mechanism 32. Similar to first support structure 48, a second support structure 61 is rotatably linked to third and fourth posts 62, 64 by third and fourth glide links 66, 68. Third and fourth posts 62, 64 are each fixed to a second longitudinal frame member 70 of frame assembly 60. Each of the first, second, third and fourth posts 52, 54, 62, 64 can stand upright (substantially vertical) in a neutral position of actuation mechanism 32 and according to several embodiments are oriented substantially transverse to a longitudinal axis of the first and second longitudinal frame members 59, 70.

In addition, according to several embodiments the first and second longitudinal frame members 59, 70 can also be oriented at an angle with respect to the first and second longitudinal frame members 59, 70, or with respect to the ground or floor surface, or the ground or floor surface itself can be non-planar, each of the first, second, third and fourth posts 52, 54, 62, 64 can therefore also be oriented at an angle with respect to the floor or ground surface. However, in all positions of the actuation mechanism 32, upper ends of the first, second, third and fourth posts 52, 54, 62, 64 are elevated above the lower ends connected to the first and second longitudinal frame members 59, 70 such that the actuation mechanism is suspended from the upper ends of the first, second, third and fourth posts 52, 54, 62, 64.

Frame assembly 60 can also include rear and front cross members 72, 74 provided to space and provide structural rigidity to right and left side assemblies 40, 42, right and left side support members 44, 46, and first and second support structures 48, 50. Occupant loads at a front portion of furniture member 10 are transferred from second and fourth posts 54, 64 to front cross frame member 74 which is connected such as by fasteners 76 (which can be bolts, threaded fasteners, extension rivets, or the like). Similarly, occupant loads at a rear portion of furniture member 10 are transferred from first and third posts 52, 62 to rear cross frame member 72 which is connected such as by fasteners 76 (not clearly visible in this view) to rear cross frame member 72. Right and left frame extensions 78, 80 are connected to rear cross frame member 72 by fasteners 76 (not visible in this view). In some embodiments the frame members of frame assembly 60 can be created from formed, bent and/or extruded angle elements, of metal such as steel or aluminum, or of polymeric or composite materials. The present disclosure is not limited by the material used for the frame components.

Figure 4:
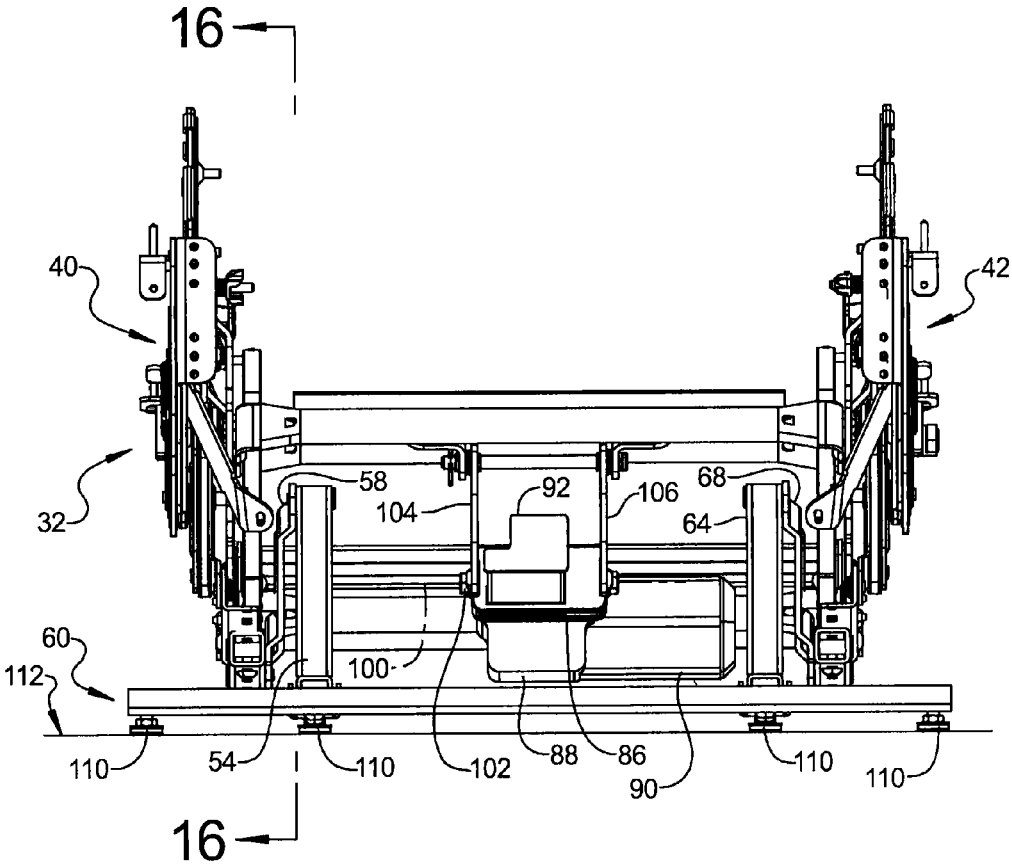
FIG. 4 is a front elevational view of the glider mechanism of FIG. 3.

A rear cross brace 82 and a front cross brace 84 connect right and left side assemblies 40, 42. A hinge pin assembly 86 (shown and described in greater detail in reference to FIG. 4) connected to rear cross brace 82 rotatably supports an electrically powered and occupant controlled drive assembly 88. A motor 90 such as an AC or DC electric motor is connected to drive assembly 88 to provide powered operation of actuation mechanism 32 via drive assembly 88. A gear housing 92 can extend forward from drive assembly 88 and provide for a gear drive such as a worm drive gear. Drive assembly 88 and gear housing 92 are together freely rotatable with respect to hinge pin assembly 86. A cover member 94 is connected to right and left side support members 44, 46 which at least partially covers hinge pin assembly 86, drive assembly 88 and motor 90. Right and left seat back support members 96, 98 are rotatably connected to individual ones of the right and left side assemblies 40, 42.

Referring to FIG. 4 and again to FIG. 3, drive assembly 88 is rotatable about a longitudinal axis of rotation 100 defined by a hinge pin 102 rotatably received in hinge pin assembly 86. Drive assembly 88 including motor 90 and gear housing 92 rotate about longitudinal axis of rotation 100 from the position shown in FIG. 3 in an upward arc of rotation "A" as the leg rest assembly 24 (only partially shown in FIG. 3 as first and second pantograph linkage sets 34, 35 and first and second leg rest support arms 36, 37) is rotated from the stowed position towards an extended position. The drive assembly 88 is connected in part using first and second rigid drive links 104, 106 to a drive rod 108 (more clearly visible in FIG. 3). Each of the first and second rigid drive links 104, 106 are fixedly connected to drive assembly 88. Actuation mechanism 32 is connected to frame assembly 60 which includes a plurality of adjustable height leg members 110 to establish an even distribution of weight load of actuation mechanism 32, furniture member 10 and the occupant to a substantially planar surface 112 such as a floor.

Figure 5:
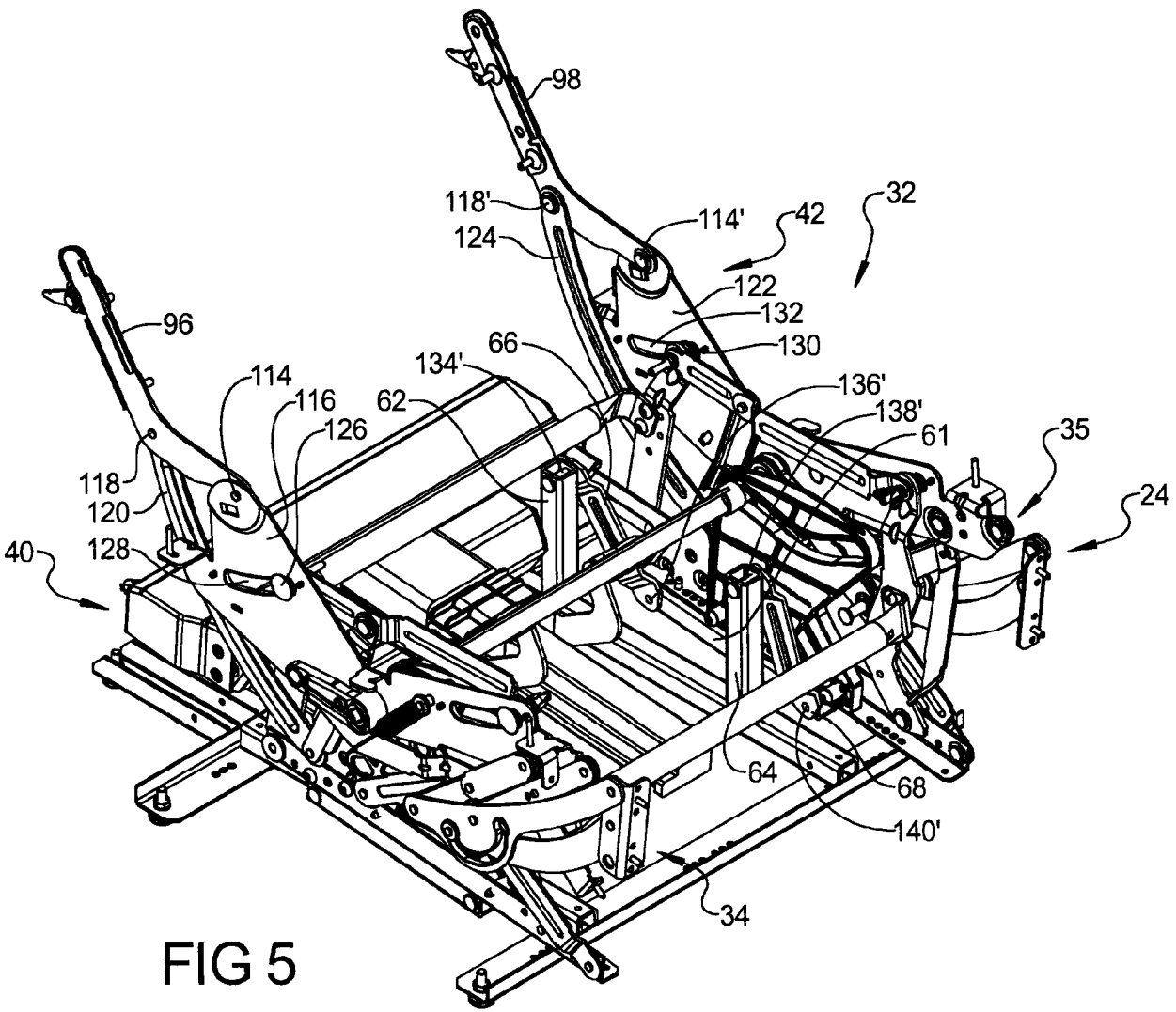
FIG. 5 is a right front perspective view of the glider mechanism of FIG. 3 in a forward glide position.

Referring to FIG. 5, with the first and second pantograph linkage sets 34, 35 of leg rest assembly 24 in the fully retracted position, and both right and left seat back support members 96, 98 in the seat back upright positions, actuation mechanism 32 can be moved using the force of an occupant of the furniture member (for example by a forward rocking motion or by using the occupant's feet to pull the mechanism forward) to a forward glide position shown. Right seat back support member 96 is rotatably connected using a rotational fastener 114 to a first plate member 116 of right side assembly 40. Right seat back support member 96 is also rotatably connected using a rotational fastener 118 to a first arc shaped link 120. Similarly, left seat back support member 98 is rotatably connected to a second plate member 122 of left side assembly 42 using a rotational fastener 114'. Left seat back support member 98 is further rotatably connected to a second arc shaped link 124 using a rotational fastener 118'.

The seat back fully upright position is also maintained by contact between a first pin 126 and a forward end of an elongated slot 128 created in first plate member 116. Similarly, a second pin 130 is in contact with a forward end of an elongated slot 132 created in second plate member 122 in the seat back fully upright position.

Because the elements of right side assembly 40 are not clearly visible in this view, the following discussion with respect to the elements of left side assembly 42 apply equally to the elements in a mirror image configuration arranged in the right side assembly 40. As the force applied by the occupant of the furniture member is applied in the forward direction with respect to actuation mechanism 32, third and fourth glide links 66, 68 rotate counter-clockwise as viewed in FIG. 5 with respect to third and fourth posts 62, 64. Third glide link 66 is rotatably connected to third post 62 at an upper end of third post 62 using a rotational fastener 134' such as a spin rivet. An opposed or lower end of third glide link 66 is rotatably connected to second support structure 61 using a rotational fastener 136'. Similarly, an upper end of fourth glide link 68 is rotatably connected to an upper end of fourth post 64 using a rotational fastener 138'. A lower end of fourth glide link 68 is rotatably connected to second support structure 61 using a rotational fastener 140'. There is no positive stop for forward glide motion of actuation mechanism 32, so the total displacement in the forward direction can vary between individual swings.

Figure 6:
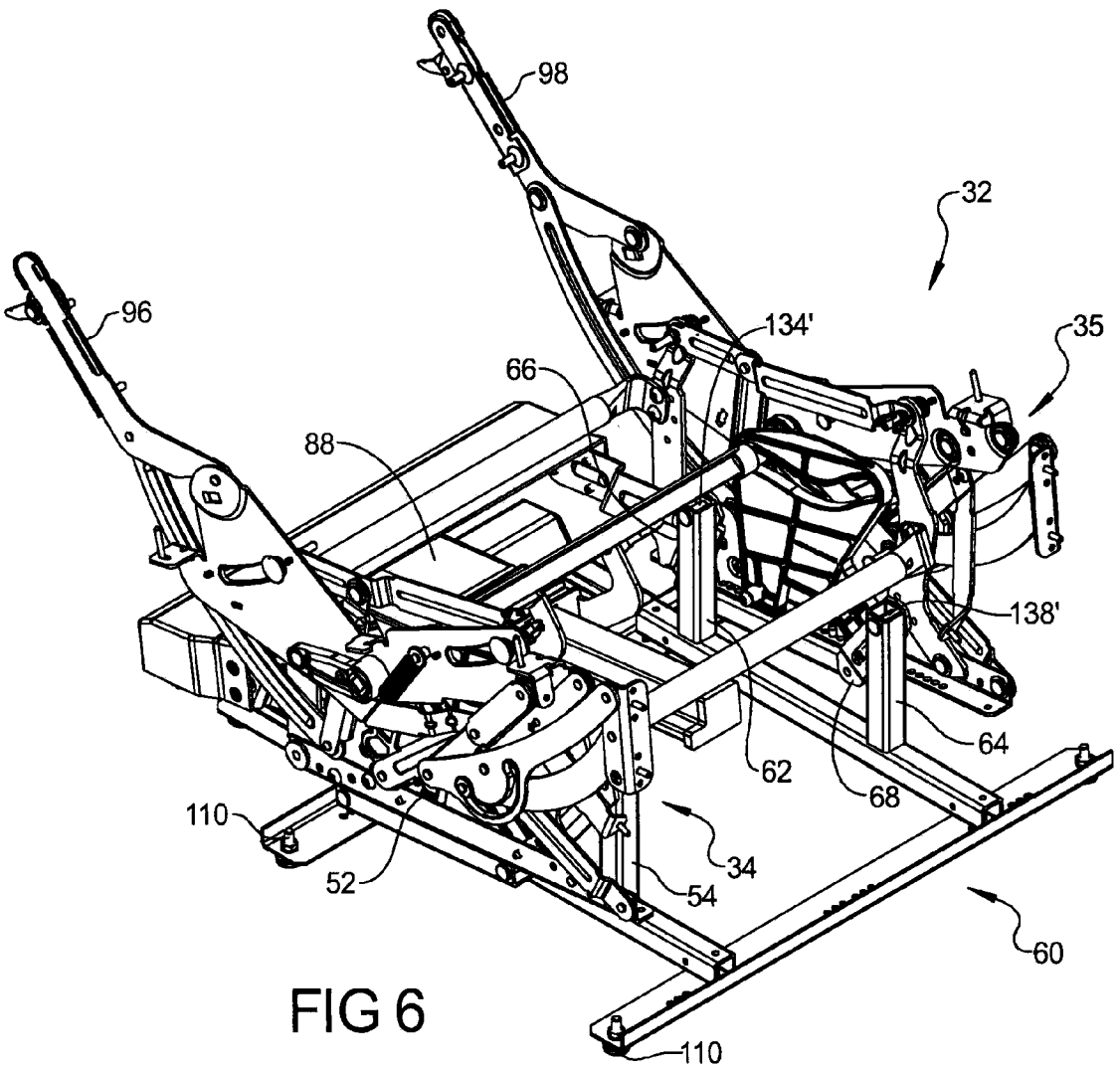
FIG. 6 is a right front perspective view of the glider mechanism of FIG. 3 in a rearward glide position.

Referring to FIG. 6, actuation mechanism 32 is shown in a rear glide position with first and second pantograph linkage sets 34, 35 in the fully retracted position and right and left seat back support members 96, 98 in the fully upright positions. It is noted that no powered operation of drive assembly 88 is required to reach either the rear glide position shown in FIG. 6 or the forward glide position shown in FIG. 5. Therefore, gliding motion is provided by manual force input from the occupant of the furniture member only. In the rear glider position, the lower end of third glide link 66 is positioned rearwardly of third post 62. Similarly, the lower end of fourth glide link 68 is also positioned rearwardly of fourth post 64. Frame assembly 60 is configured to support actuation mechanism 32 between the full extent of the rear glide position and the forward glide position such that each of the adjustable height leg members 110 remain in contact with the planar surface 112 shown and described with reference to FIG. 4.

Figure 7:
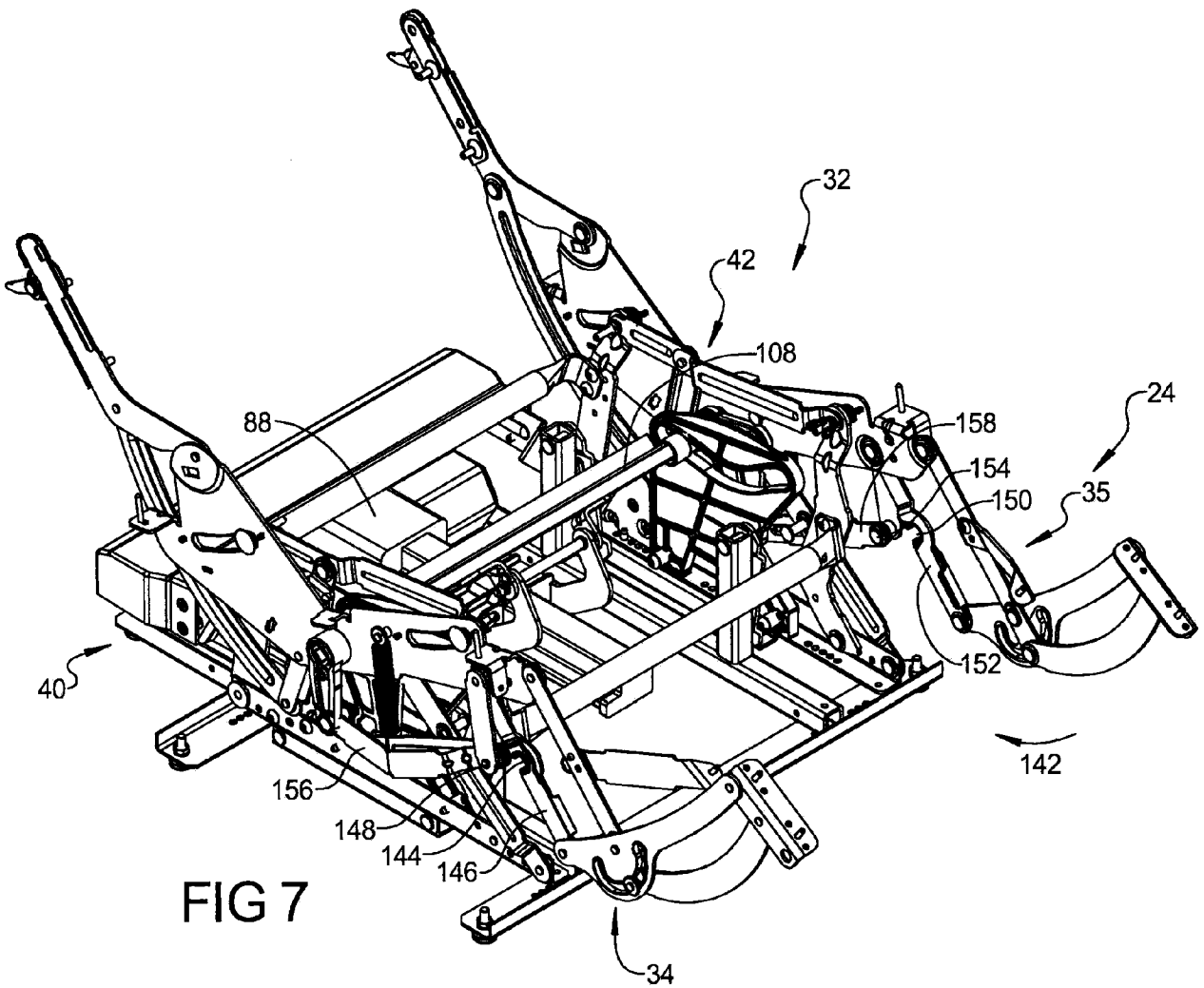
FIG. 7 is a right front perspective view of the glider mechanism having the leg rest assembly in a partially extended position.
Figure 19:
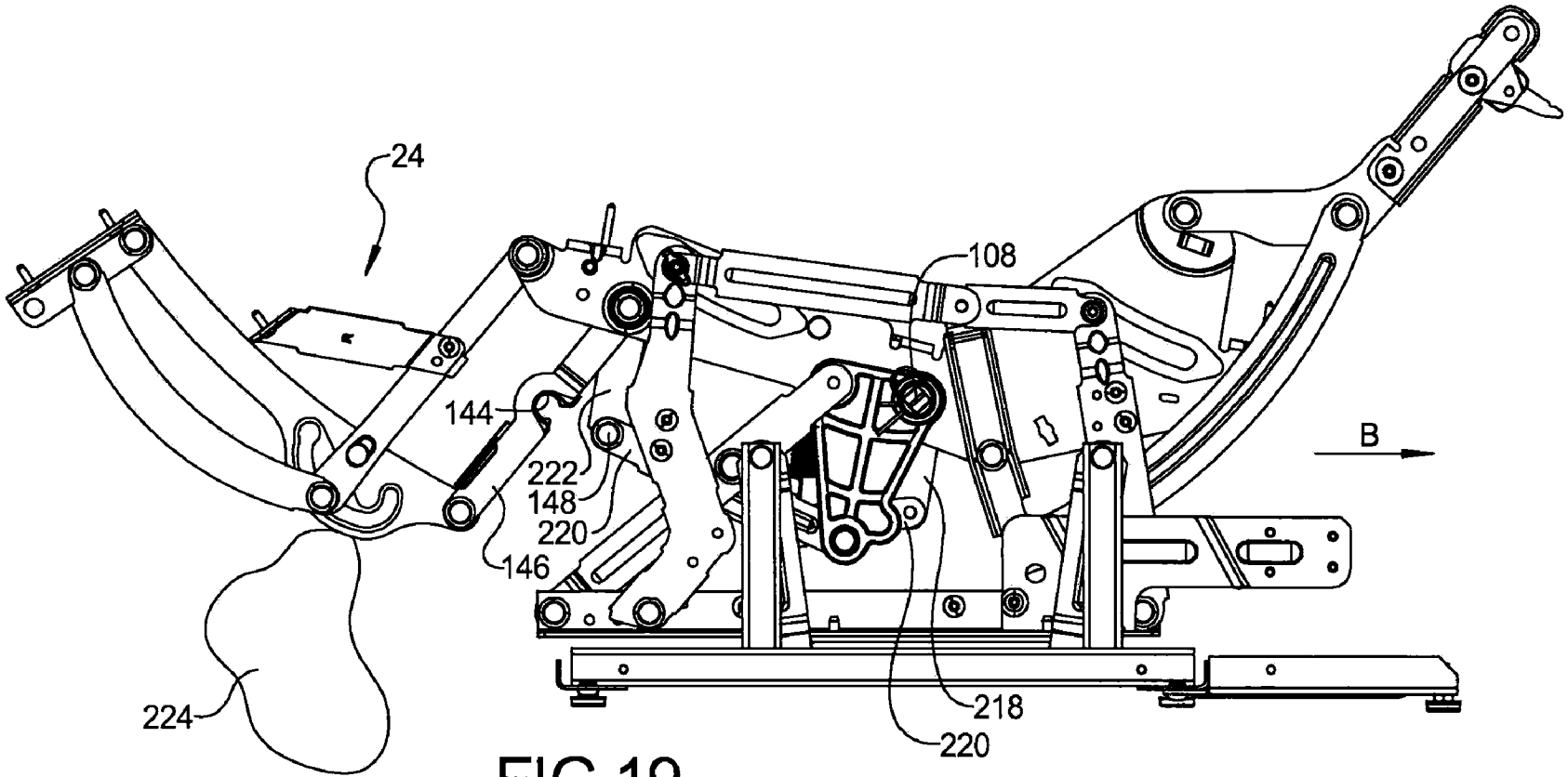
FIG. 19 is the cross sectional elevational view of the mechanism portion of FIG. 16 further showing the leg rest in a partially extended release position.

Referring to FIGS. 7 and 19, actuation mechanism 32 provides for a powered retraction of leg rest assembly 24 from the fully extended to the fully retracted positions. Therefore, if the first or second pantograph linkage sets 34, 35 contact an object 224 during rotation about a leg rest retraction arc of rotation 142, either or both of the first and second pantograph linkage sets 34, 35 include a release feature to stop further retraction motion of first and second pantograph linkage sets 34, 35 by drive assembly 88. To provide for this disconnection feature, a first semi-circular cavity 144 created in a first link member 146 of first pantograph linkage set 34 can release with respect to a first engagement pin 148. Similarly, a second semi-circular cavity 150 created in a second link member 152 of second pantograph linkage set 35 can disconnect from a second engagement pin 154. First and second pantograph linkage sets 34, 35, after release from first and second engagement pins 148, 154, will remain in contact with the object 224 until removal of the object 224, at which point the first and second pantograph linkage sets 34, 35 will return by gravity in the leg rest retraction arc of rotation 142. First engagement pin 148 is connected to a first drive link 156 and second engagement pin 154 is connected to a second drive link 158 of left side assembly 42. It is also noted that release from either or both of the first or second engagement pins 148, 154 can also occur if an object is encountered under either of the first or second pantograph linkage sets 34, 35 during gliding motion of the furniture member. Once the object is removed from contact with either or both of the first and second pantograph linkage sets 34, 35, the occupant can push either or both of the first and second pantograph linkage sets 34, 35 toward the fully retracted position of leg rest assembly 24 until re-engagement of the first and second engagement pins 148, 154 occurs.

Figure 8:
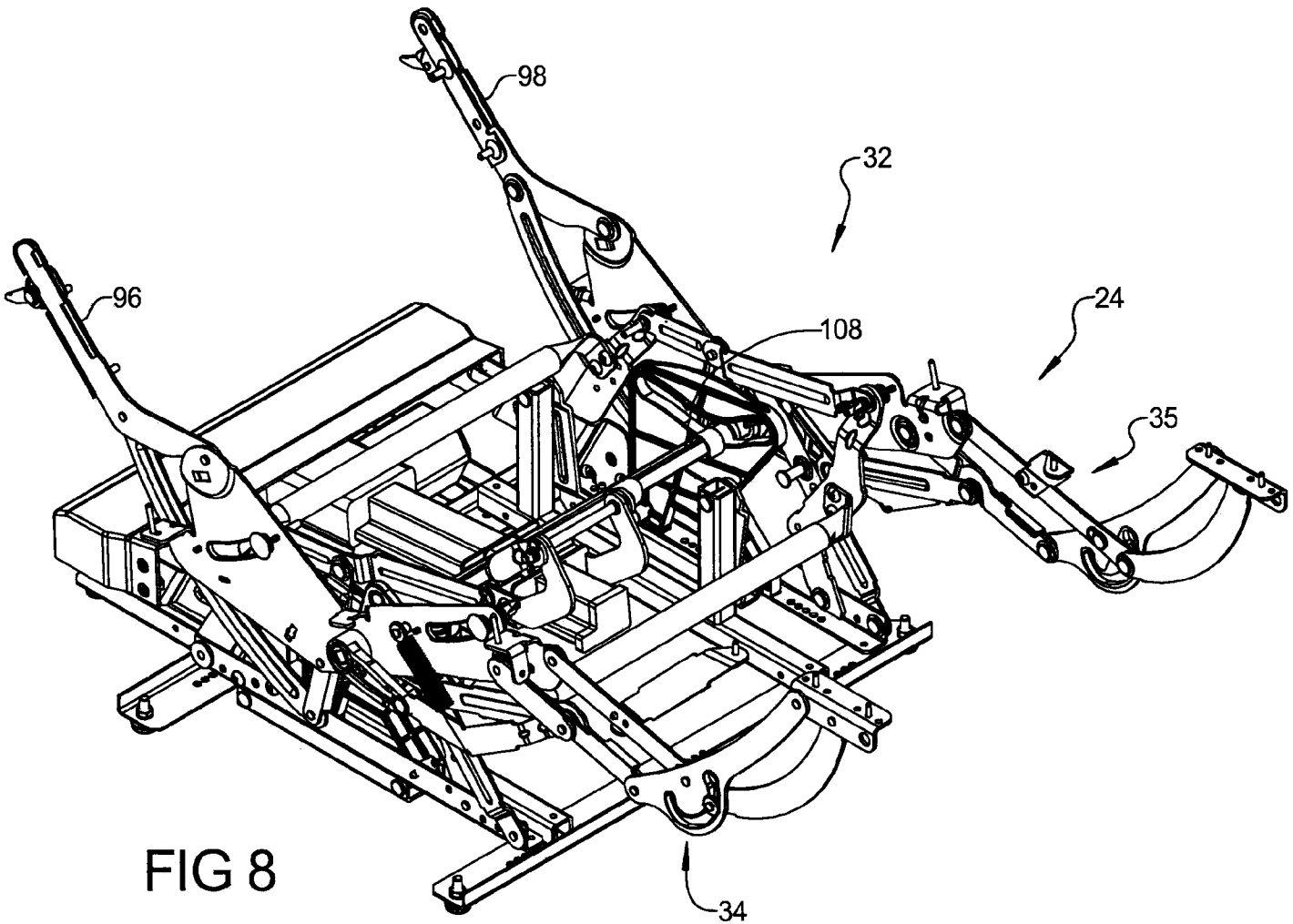
FIG. 8 is a right front perspective view of the glider mechanism in a leg rest fully extended position.

Referring to FIG. 8, first and second pantograph linkage sets 34, 35 are shown in the fully extended position of leg rest assembly 24, while right and left seat back support members 96, 98 are retained in the seat back fully upright positions.

Forward and rearward gliding motion of actuation mechanism 32 is unaffected by having the leg rest assembly 24 in the fully extended position. Because the weight of the occupant supported by leg rest assembly 24 is extended further away from the drive route rod 108, gliding motion in the forward direction may be somewhat reduced, while gliding motion in the rearward direction can increase.

Figure 9:
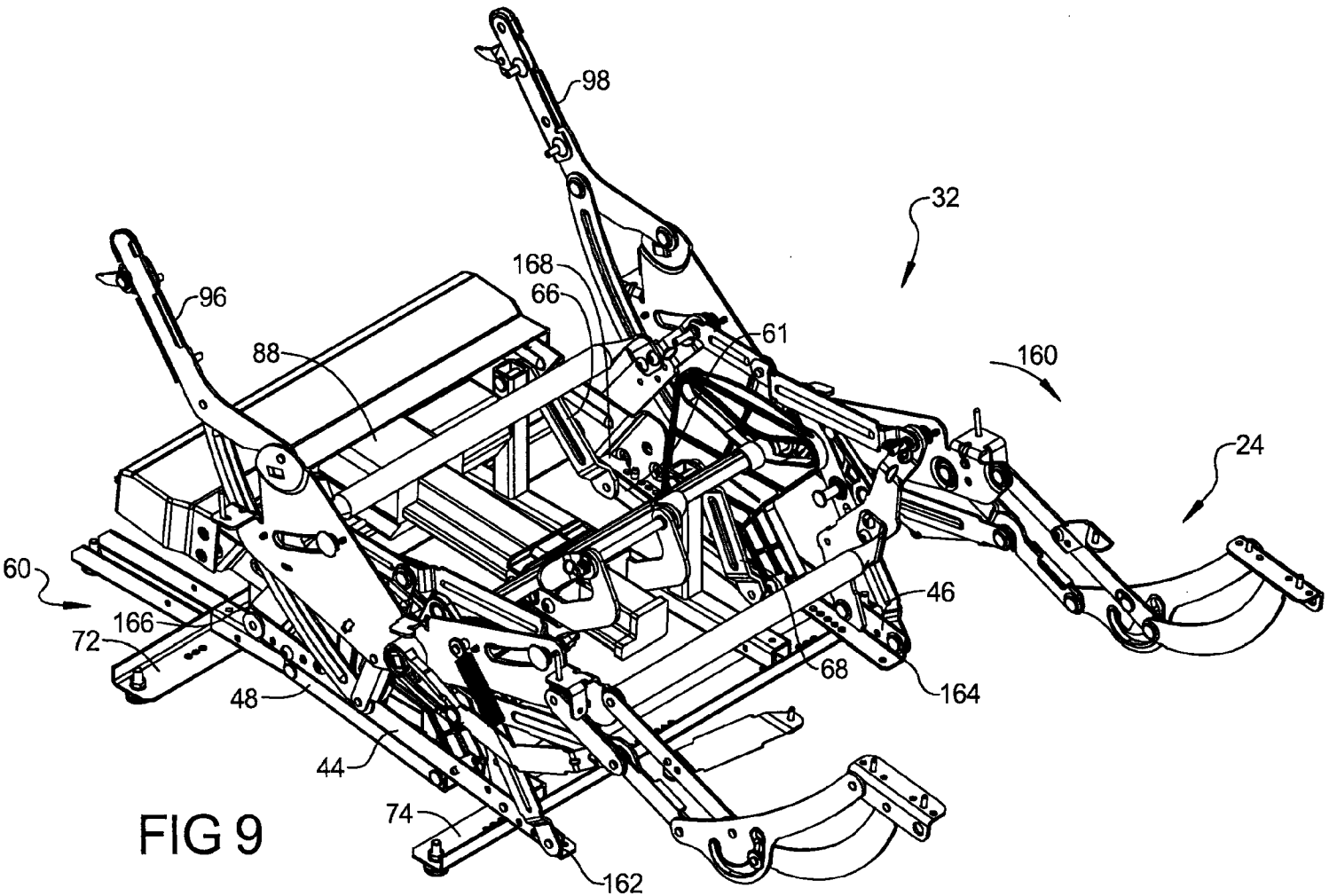
FIG. 9 is a right front perspective view of the glider mechanism with the leg rest assembly in the fully extended position and further shown in the fully forward glide position.

Referring to FIG. 9, the forward glide position of actuation mechanism 32 is shown with the leg rest assembly 24 in the fully extended position and right and left seat back support members 96, 98 positioned in the seat back fully upright position. In the forward glide position, the leg rest assembly 24 moves generally in a forward glide arc 160, which is substantially forward and downward from the neutral position shown with respect to FIG. 8. A forward facing end 162 of right side support member 44 and a forward facing end 164 of left side support member 46 are both positioned below a rear facing end 166 of right side support member 44 and a rear facing end 168 of left side support member 46. As also evident in FIG. 9, the forward facing ends 162, 164 of right and left side support members 44, 46 extend generally forward of front cross member 74 in the forward glide position.

Figure 10:
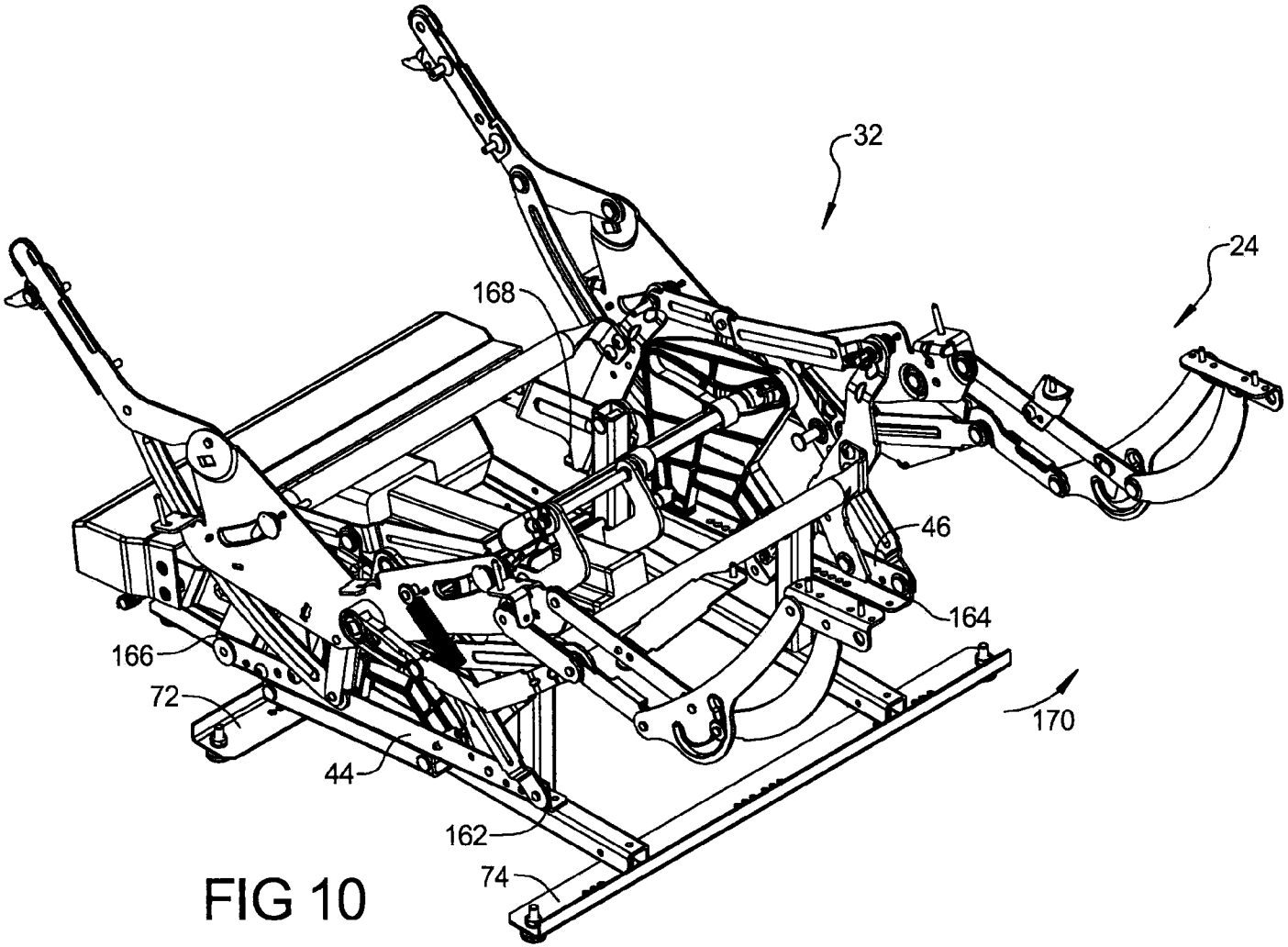
FIG. 10 is a right front perspective view of the glider mechanism with the leg rest assembly in the fully extended position and further shown in the fully rearward glide position.

Referring to FIG. 10, in the rear glider position, the leg rest assembly 24 moves in a rear glide arc of rotation 170 until forward facing ends 162, 164 of right and left side support members 44, 46 are positioned above each of the rear facing ends 166, 168 of right and left side support members 44, 46. Also in the rear glider position, rear facing ends 166, 168 of right and left side support members 44, 46 extend rearwardly of rear cross member 72.

Figure 11:
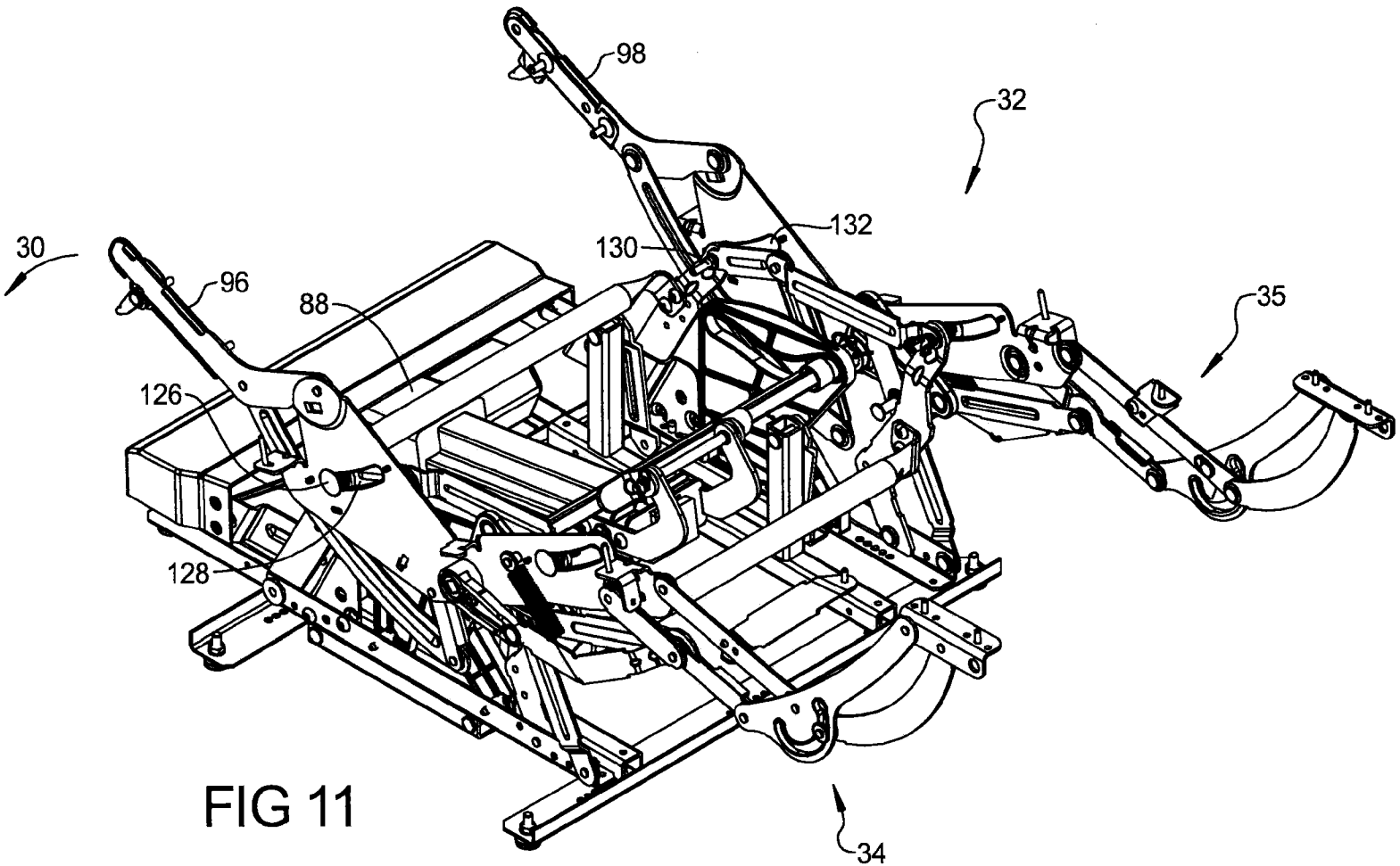
FIG. 11 is a right front perspective view of the glider mechanism with the leg rest assembly in the fully extended position and the seat back member in a fully reclined position.

Referring to FIG. 11, after first and second pantograph linkage sets 34, 35 reach the leg rest fully extended position, continued operation of drive assembly 88 thereafter rotates right and left seat back support members 96, 98 from the upright to the fully reclined position shown in FIG. 11. Right and left seat back support members 96, 98 rotate about the seat back recline arc of rotation 30 to reach the seat back fully reclined position. The seat back fully reclined position is established when first pin 126 contacts the rear facing end of elongated slot 128 and second pin 130 contacts the rear facing end of elongated slot 132, thereafter preventing further rotation about the seat back recline arc of rotation 30. It is noted that actuation mechanism 32 is capable of glide motion with both the right and left seat back support members 96, 98 in the seat back fully reclined position and the first and second pantograph linkage sets 34, 35 in the leg rest fully extended position. Glider motion of actuation mechanism 32 is, therefore, independent of drive assembly 88 in the positions shown in FIG. 11.

Figure 12:
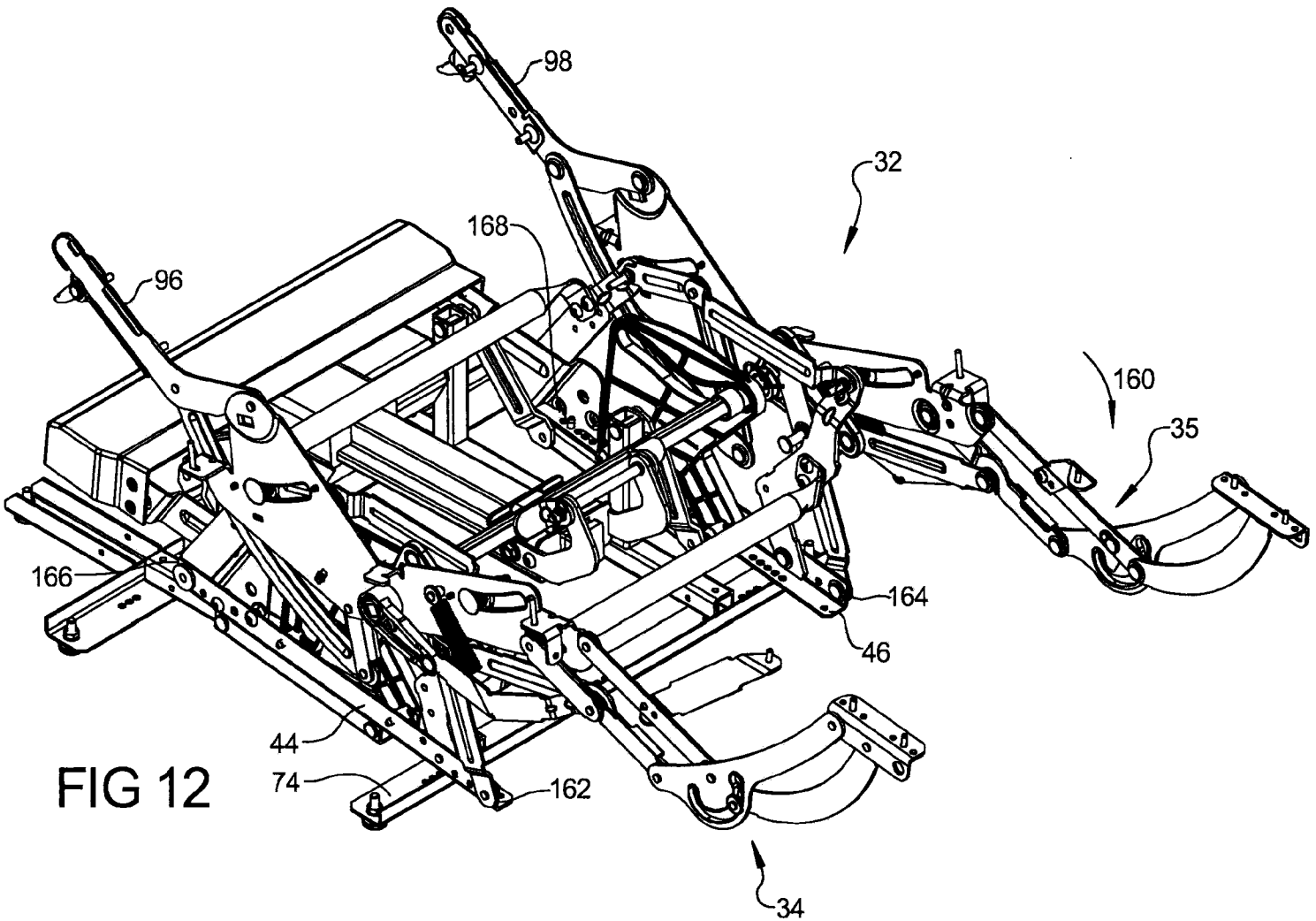
FIG. 12 is a right front perspective view of the glider mechanism with the leg rest assembly in the fully extended position and the seat back member in a fully reclined position and further shown in the fully forward glide position.

Referring to FIG. 12, the forward glider position of actuation mechanism 32 is shown with the first and second pantograph linkage sets 34, 35 in the leg rest fully extended position and right and left seat back support members 96, 98 in the fully reclined position. Similar to the positions shown and previously described with reference to FIG. 9, forward facing ends 162, 164 of right and left side support members 44, 46 are below the elevated position of rear facing ends 166, 168 of right and left side support members 44, 46. Also, forward facing ends 162, 164 are positioned generally forward of front cross member 74 in this forward glider position. Because the weight of the occupant can be distributed in a further rearward direction when the right and left seat back support members 96, 98 are positioned in the fully reclined position, total rearward motion of actuation 32 may be reduced with respect to the configuration shown and described in reference to FIG. 9.

Figure 13:
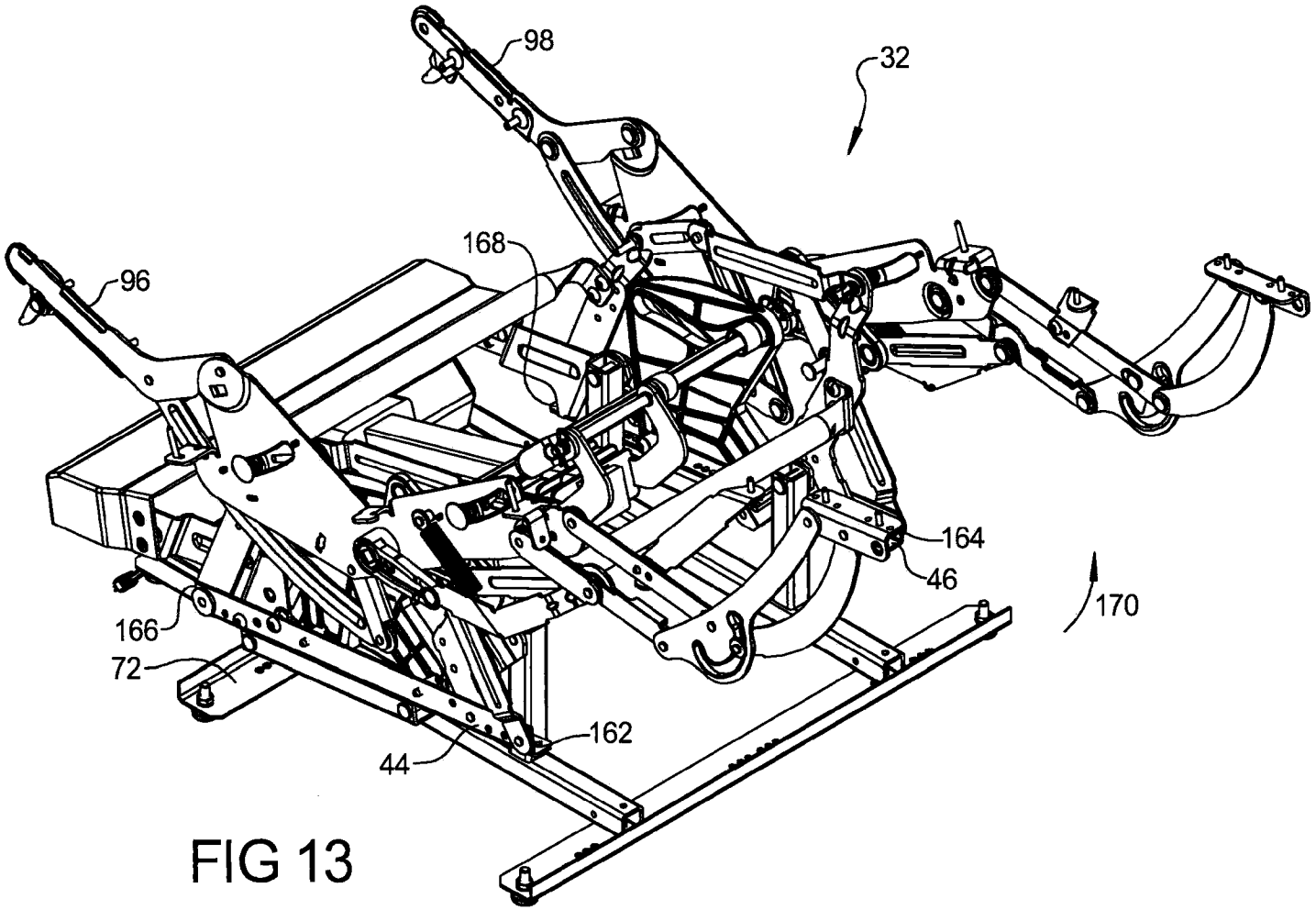
FIG. 13 is a right front perspective view of the glider mechanism with the leg rest assembly in the fully extended position and the seat back member in a fully reclined position and further shown in the fully rearward glide position.

Referring to FIG. 13, when right and left seat back support members 96, 98 are in the fully reclined position the rear glider position of actuation mechanism 32 results in forward facing ends 162, 164 of right and left side support members 44, 46 being positioned in an elevated position with respect to rear facing ends 166, 168 of right and left side support members 44, 46. Similar to the orientation shown and described with reference to FIG. 10, rear facing ends 166, 168 are positioned rearwardly with respect to rear cross member 72 in the rear glider position.

Figure 14:
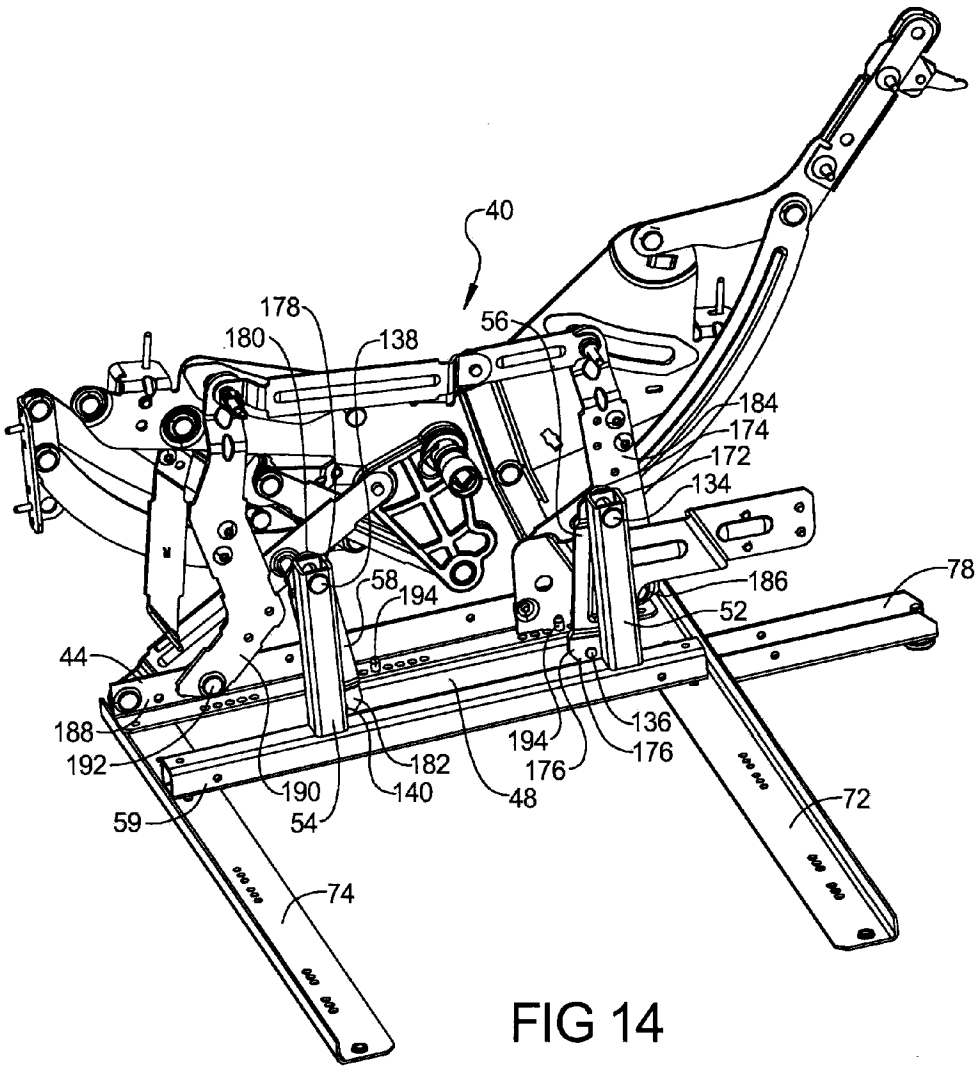
FIG. 14 is a front left perspective view of the right side assembly of the mechanism of FIG. 3.

Referring to FIG. 14, features of right side assembly 40 are shown and described. Features of left side assembly 42 are mirror images of right side assembly 40 and are therefore not further discussed. Rotational fastener 134 is received proximate an upper post end 172 of first post 52. Rotational fastener 134 extends through an upper link end 174 of first glide link 56 to rotatably connect first glide link 56 to first post 52. Rotational fastener 136 is rotationally received through a lower link end 176 of first glide link 56 and a rear facing end of first support structure 48 to rotatably connect first glide link 56 to first support structure 48. Rotational fastener 138 is received proximate an upper post end 178 of second post 54. Rotational fastener 138 extends through an upper link end 180 of second glide link 58 to rotatably connect second glide link 58 to second post 54. Rotational fastener 140 is rotationally received through a lower link end 182 of second glide link 58 and a forward facing end of first support structure 48 to rotatably connect second glide link 58 to first support structure 48.

Right side assembly 40 is rotatably connected at a rear support link 184 rotatably connected using a rotational fastener 186 to a first flange 188 of right side support member 44. A forward support link 190 is also rotatably connected using a rotational fastener 192 to first flange 188 of right side support member 44. Right side support member 44 is fastened to first support structure 48 using fasteners 194. Approximately half the weight of the actuation mechanism, the upholstery components, and the occupant of the furniture member is therefore borne by first support structure 48 which is suspended from the first and second posts 52, 54 by the first and second glide links 56, 58. Forward and rearward gliding motions of the actuation mechanism are therefore allowed by rotation of the rotational fasteners 134, 138 connected to first and second posts 52, 54, and by rotation of rotational fasteners 136, 140 with respect to first support structure 48.

Figure 15:
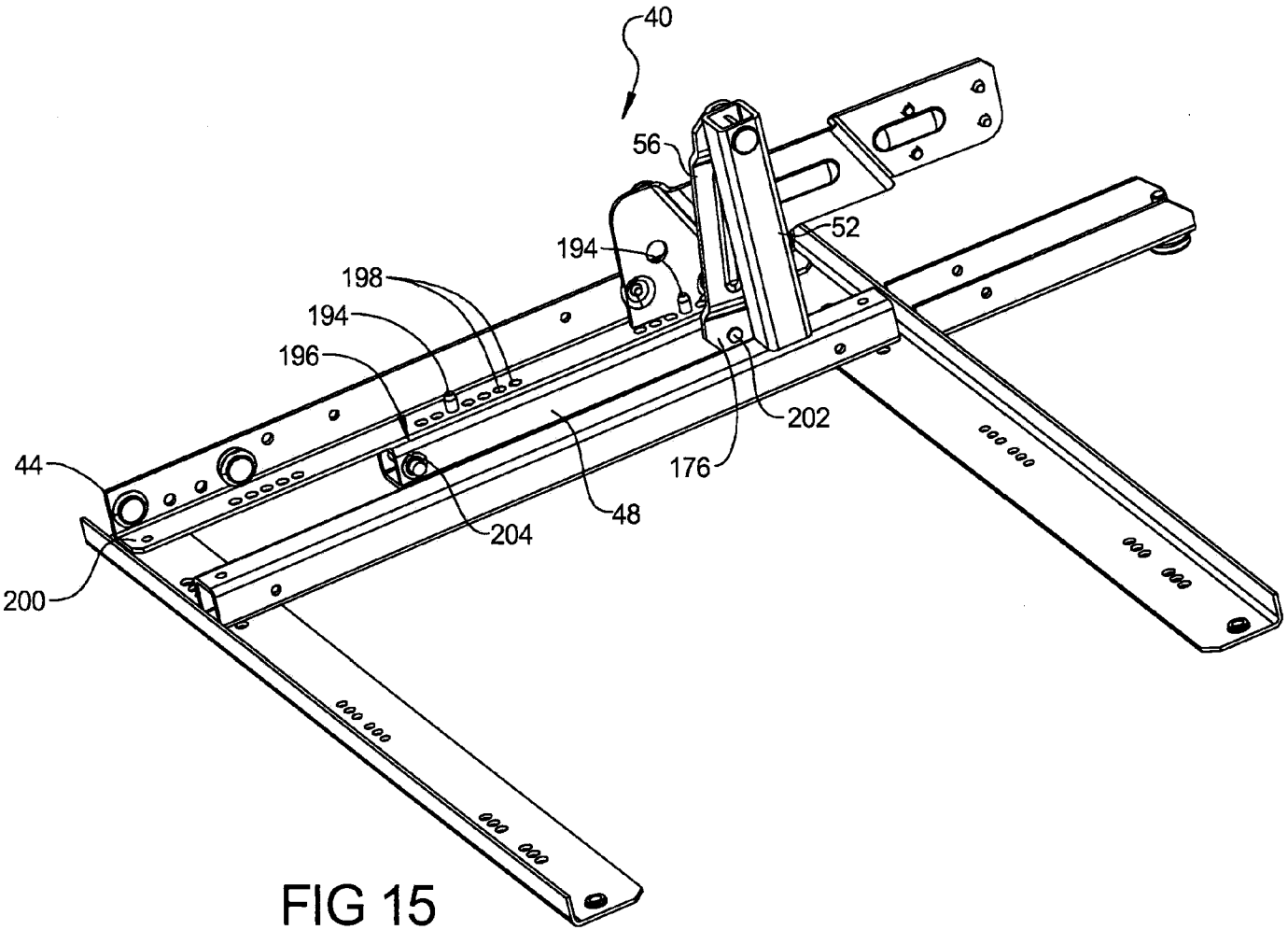
FIG. 15 is a front left perspective view modified from FIG. 14 to remove further components for clarity.

Referring to FIG. 15 and again to FIGS. 5 and 14, fasteners 194 extend upwardly from a planar face 196 of first support structure 48 and are received through selected ones of a plurality of apertures 198 created in a second flange 200 of right side support member 44. A fastener aperture 202 created in lower link end 176 of first glide link 56 (and similarly created in the lower link end 182 of second glide link 58) is axially aligned with bearing tubes 204 positioned at opposite ends of first support structure 48. Bearing tubes 204 are sized to permit rotational movement of rotational fasteners 136, 140 receiving within a bore of bearing tubes 204. Bearing tubes 204 can be fixed such as by flaring, peening, welding, or similar fixing operation through a substantially rectangular shaped body of first support structure 48.

Figure 16:
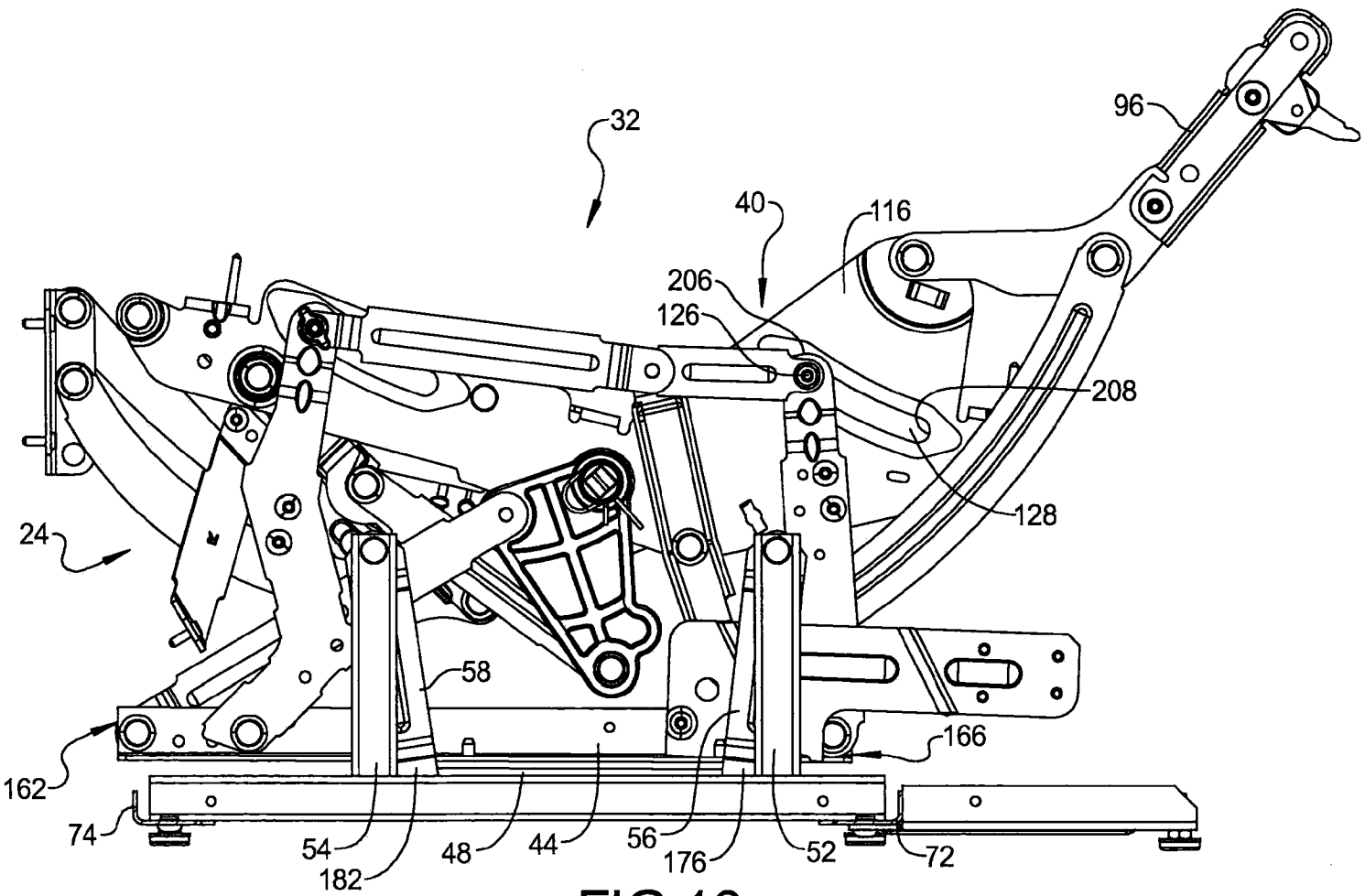
FIG. 16 is a cross sectional elevational view taken at section 16 of FIG. 4.

Referring to FIG. 16, a neutral or start position of actuation mechanism 32 is depicted. In the neutral position, the leg rest assembly 24 is in the fully retracted position and the seat back member represented by right seat back support member 96 is in the fully upright position. The seat back fully upright position is defined by contact between first pin 126 and a forward end 206 of elongated slot 128 created in first plate member 116. The seat back fully reclined position is reached (which is shown and described in better detail in reference to FIG. 21) when first pin 126 contacts an oppositely located rearward facing end 208 of elongated slot 128. To help retain a stable neutral position, the lower link ends 176, 182 of first and second glide links 56, 58 can be angled toward each other, in lieu of being oriented substantially co-axial with the first and second posts 52, 54.

Figure 17:
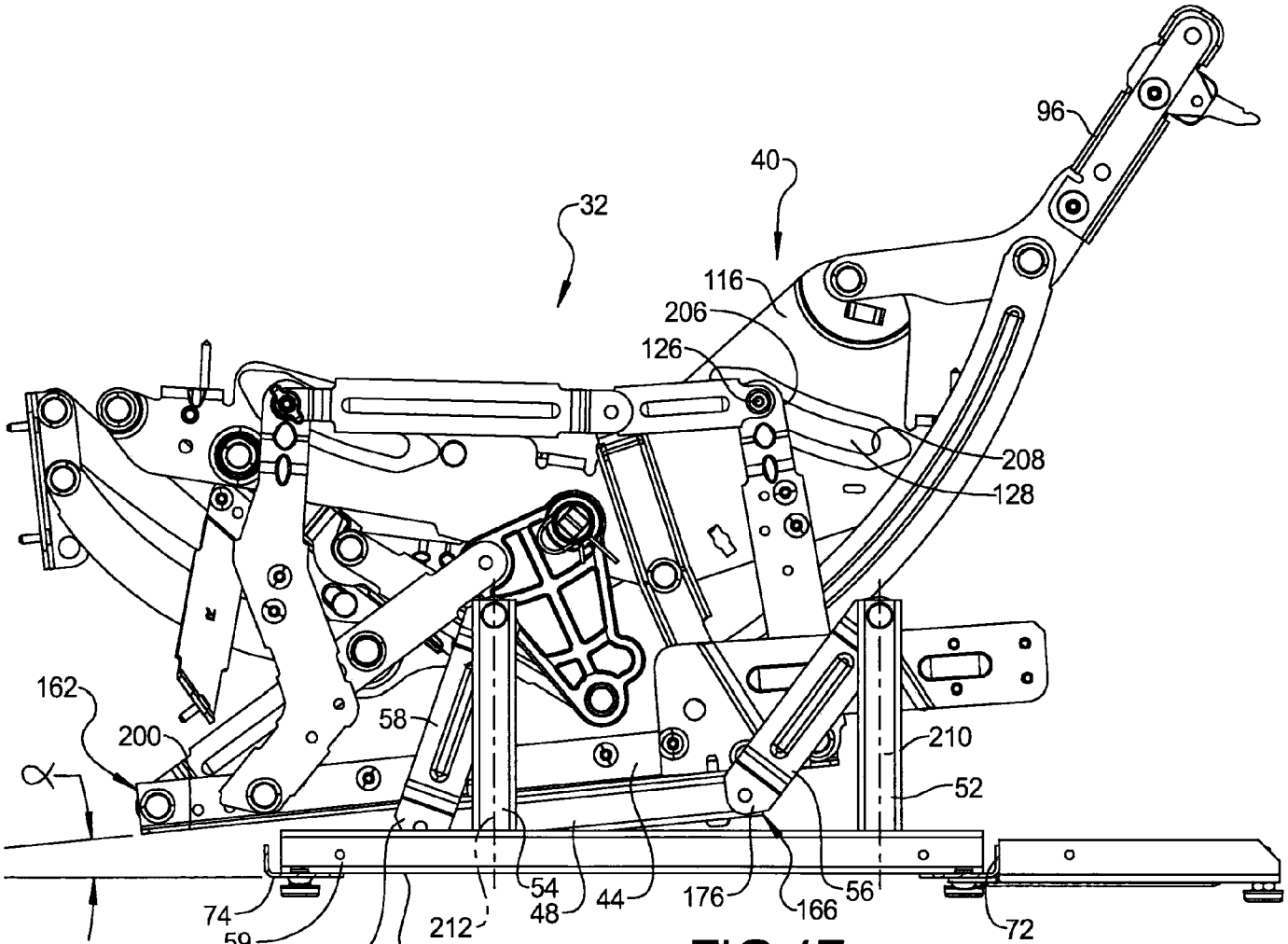
FIG. 17 is the cross sectional elevational view of the mechanism portion of FIG. 16 further shown in the forward glide position.

Referring to FIG. 17, with leg rest assembly 24 in the fully retracted position and the seat back member represented by right seat back support member 96 in the fully upright position, when actuation mechanism 32 is moved to the forward glide position the rotational fasteners 136, 140 connected to lower link ends 176 and 182 of first and second glide links 56, 58 are individually positioned substantially forward of first and second longitudinal axes 210, 212 of the respective first and second posts 52, 54. Forward facing end 162 of right side support member 44 is positioned forward of front cross member 74, and rear facing end of 166 of right side support member 44 is positioned forward of second longitudinal axis 212. In the forward glide position second flange 200 of right side support member 44 defines an angle alpha ($\alpha$) with respect to the plane defined by a lower surface 216 of first longitudinal frame member 59.

Figure 18:
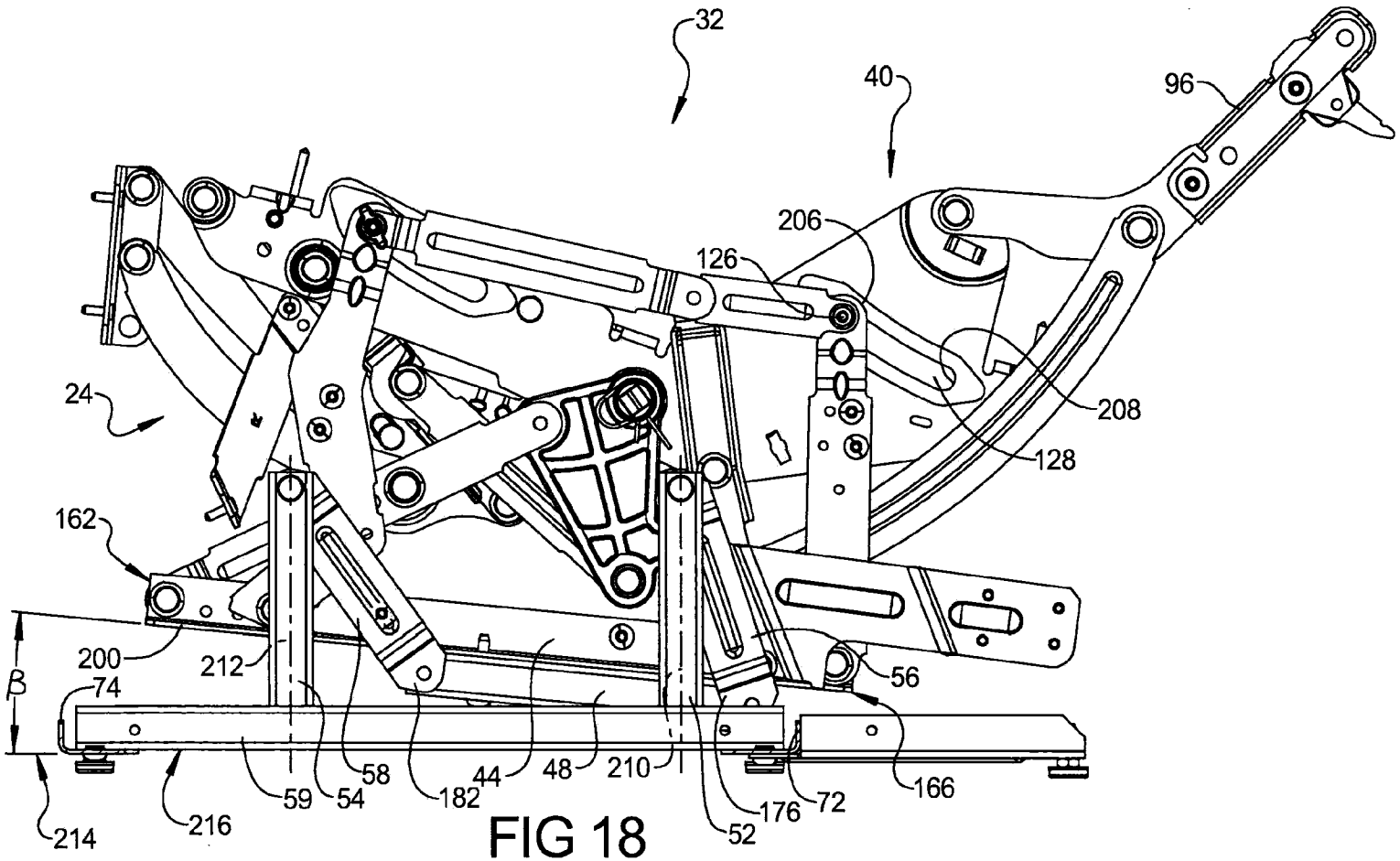
FIG. 18 is the cross sectional elevational view of the mechanism portion of FIG. 16 further shown in the rearward glide position.

Referring to FIG. 18, with leg rest assembly 24 in the fully retracted position and the seat back member represented by right seat back support member 96 in the fully upright position, when actuation mechanism 32 is moved to the rear glide position the rotational fasteners 136, 140 connected to lower link ends 176 and 182 of first and second glide links 56, 58 are individually positioned substantially rearward of first and second longitudinal axes 210, 212 of the respective first and second posts 52, 54. Forward facing end 162 of right side support member 44 is positioned rearward of front cross member 74, and rear facing end of 166 of right side support member 44 is positioned rearward of second longitudinal axis 212. In the rear glide position second flange 200 of right side support member 44 defines an angle beta ($\beta$) with respect to a plane 214 defined by lower surface 216 of first longitudinal frame member 59.

Referring to FIG. 19, when leg rest assembly 24 is in the leg rest release condition, first semi-circular cavity 144 created in first link member 146 of first pantograph linkage set 34 releases from engagement to first engagement pin 148. Thereafter, continued rotation of drive rod 108 can occur (in a clockwise direction as viewed in FIG. 19) which rotates a leg rest lock link 218, which retracts an extension link 220. Extension link 220 is connected by first engagement pin 148 to a connecting link 222. Rotation of leg rest lock link 218 occurs until leg rest lock link 218 is oriented substantially facing a rearward direction "B" with respect to drive rod 108. Once an object 224 which is hindering retraction of leg rest assembly 24 is removed, leg rest assembly 24 can return by gravity toward the leg rest fully retracted position, and engagement pin 148 can be manually re-engaged with first semi-circular cavity 144 for subsequent powered operation of leg rest assembly 24.

Figure 20:
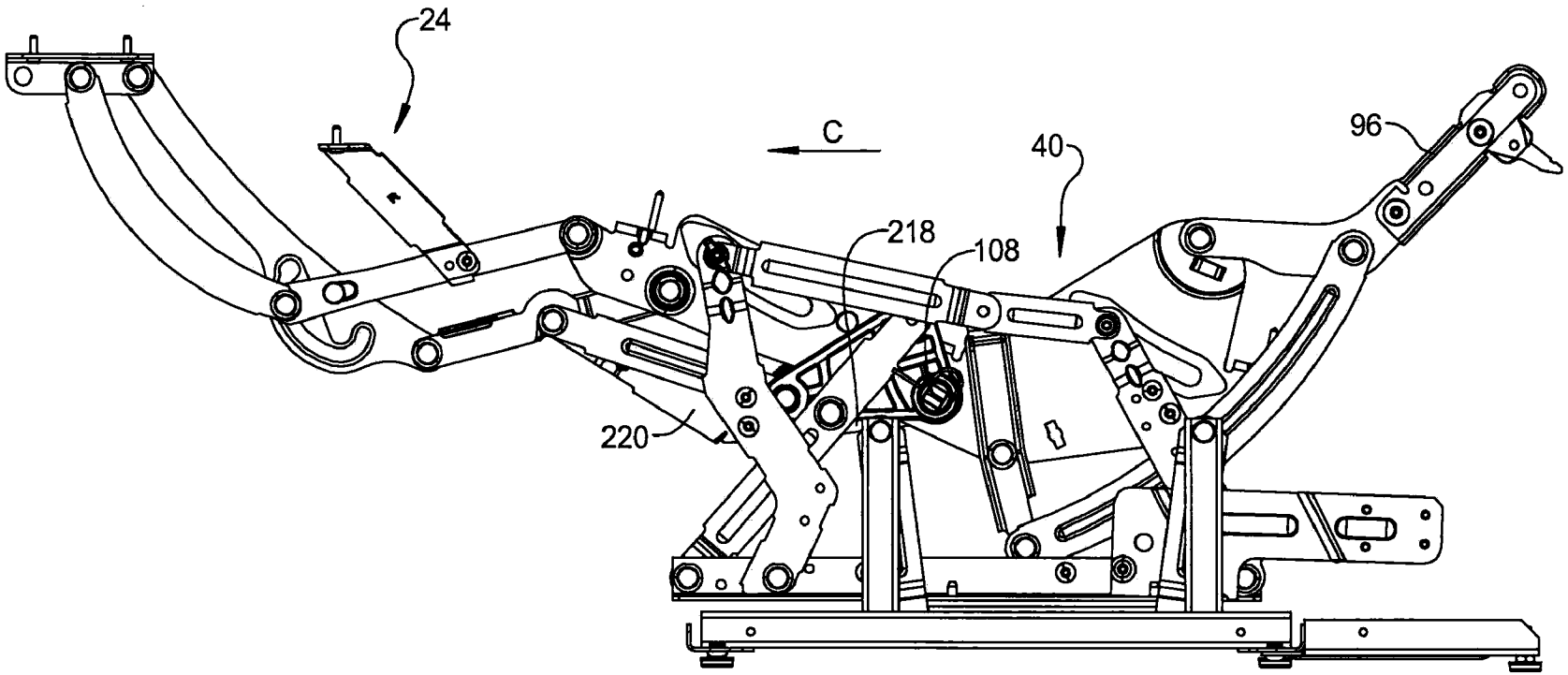
FIG. 20 is the cross sectional elevational view of the mechanism portion of FIG. 16 further showing the leg rest in the fully extended position and the seat back in the fully upright position.

Referring to FIG. 20, to reach the leg rest assembly fully extended position, leg rest assembly 24 is extended in a generally forward direction "C" by rotation and forward displacement of drive rod 108 until leg rest lock link 218 is generally directed in the forward direction "C" with respect to drive rod 108 and extension link 220 directs full forward extension of leg rest assembly 24. Forward and rear glider motions are still permitted with leg rest assembly 24 in the fully extended position.

Figure 21:
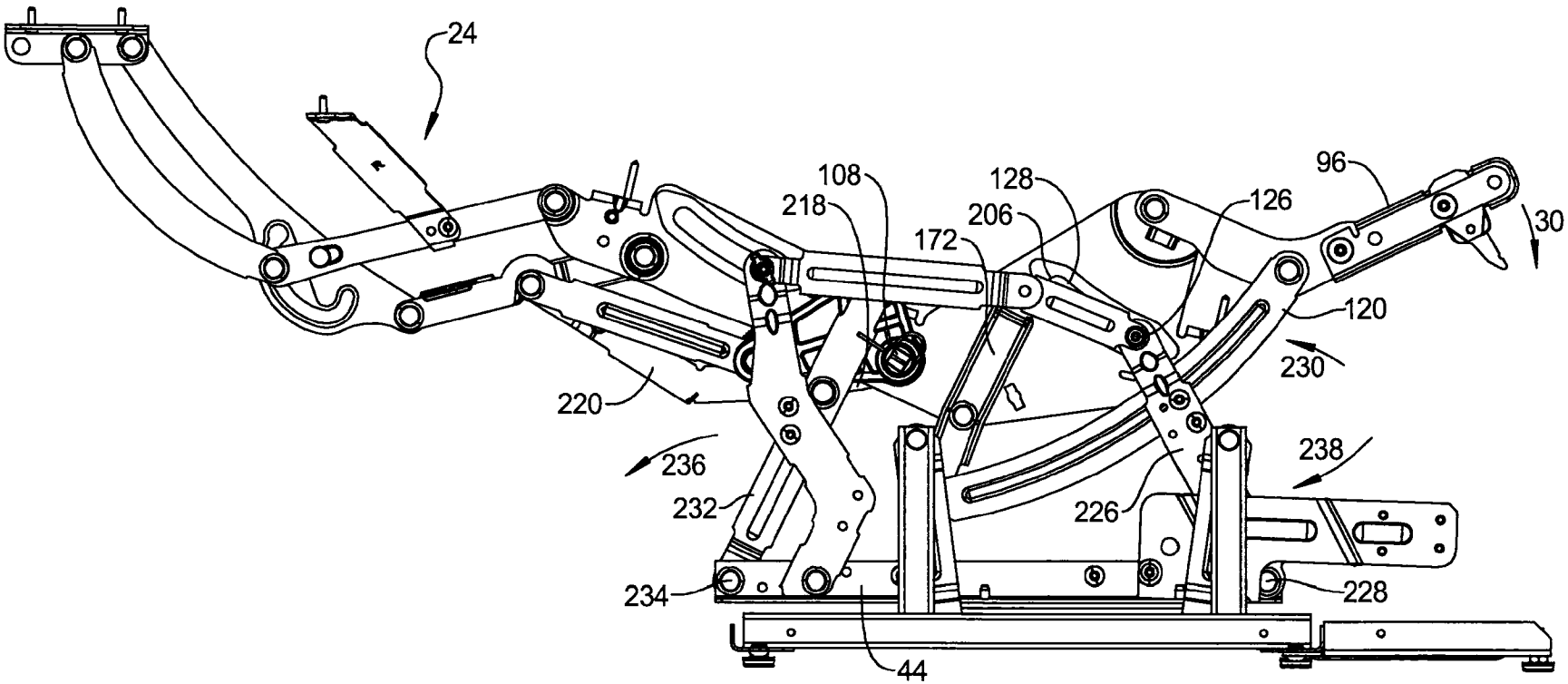
FIG. 21 is the cross sectional elevational view of the mechanism portion of FIG. 16 further showing the leg rest in the fully extended position and the seat back in the fully reclined position.

Referring to FIG. 21, after the fully extended position of leg rest assembly 24 is reached, the seat back member represented by right seat back support member 96 can be rotated from the fully upright to the fully reclined position shown by rotation in the seat back recline arc of rotation 30. Further axial rotation of drive rod 108 stops upon reaching the fully extended position of leg rest assembly 24, therefore drive rod 108 is forwardly displaced only which causes rotation of a second rear support link 226 connected to right side support member 44 by a rotational fastener 228 about an arc of rotation 230. Forward displacement of drive rod 108 further causes rotation of a second front support link 232 connected to right side support member 44 by a rotational fastener 234 about an arc of rotation 236. First arc shaped link 120 displaces in an arc of rotation 238 allowing right seat back support member 96 to rotate about arc of rotation 30, which is limited by displacement of first pin 126 away from forward slot end 206 until first pin 126 contacts rear facing slot end 208 of elongated slot 128.

Figure 22:
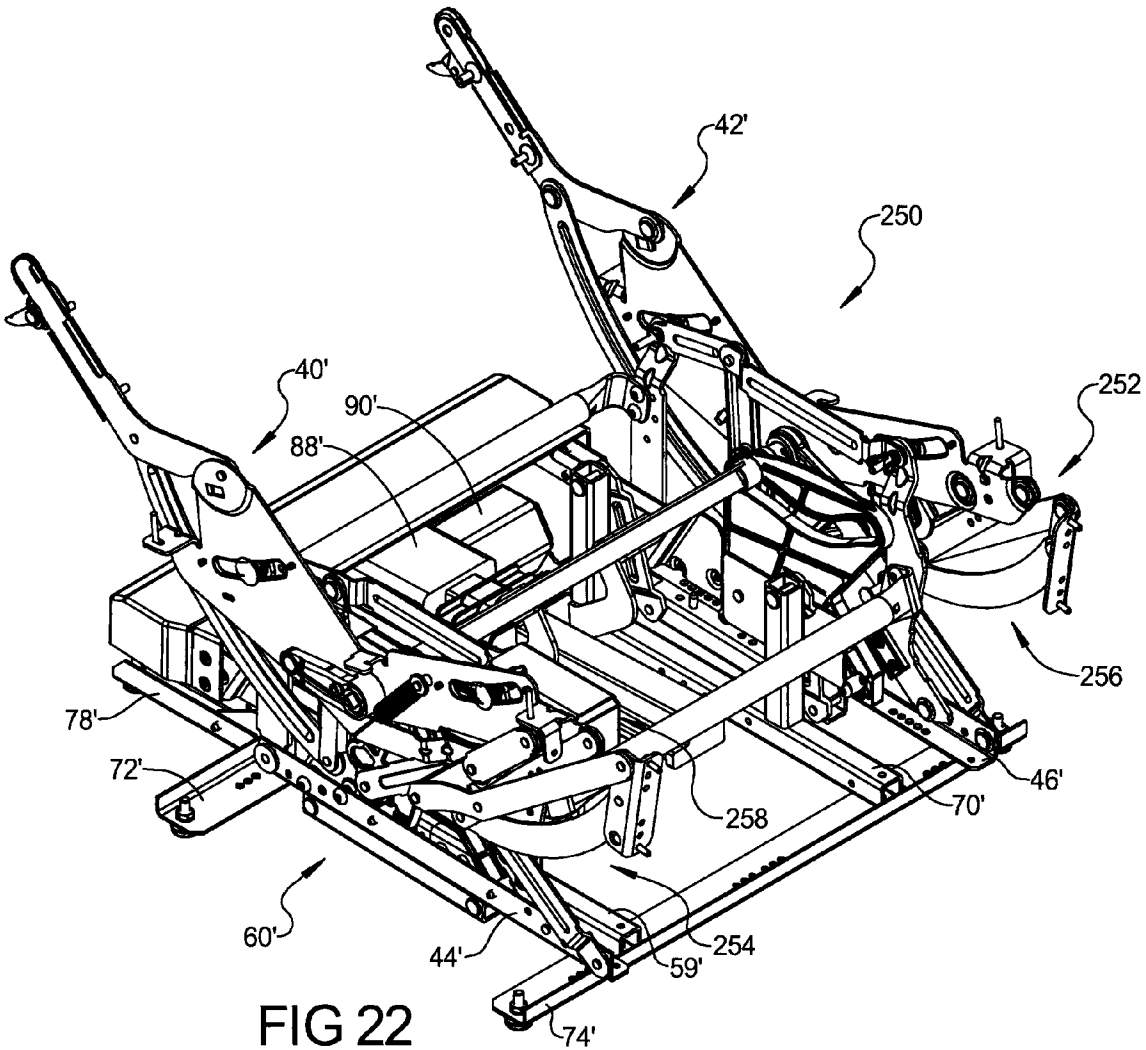
FIG. 22 is a right front perspective view of a powered gliding motion mechanism of the present disclosure.

Referring to FIG. 22, an actuation mechanism 250 is modified from actuation mechanism 32 to include a leg rest assembly 252 having first and second pantograph linkage sets 254, 256 which are extendible or retractable to the stowed position shown. Actuation mechanism 250 is further modified from actuation mechanism 32 with the inclusion of a powered glider drive device 258 which allows for powered automatic gliding motion of the actuation mechanism 250. Automatic gliding motion is defined herein as a powered gliding motion which does not rely on force or input by an occupant of the furniture member. Actuation mechanism 250 is supported and connected to frame assembly 60' and includes rear and front cross members 72', 74' which are fastenably connected to first and second longitudinal frame members 59', 70'. Actuation mechanism 250 is, therefore, capable of the full gliding motion, as previously described herein, with respect to frame assembly 60'. Drive assembly 88' and motor 90' are further included, as previously described, to provide for powered actuation of the leg rest assembly 252 as well as powered movement of the right and left side assemblies 40', 42' for movement of the seat back from the upright to the fully reclined positions.

Figure 23:
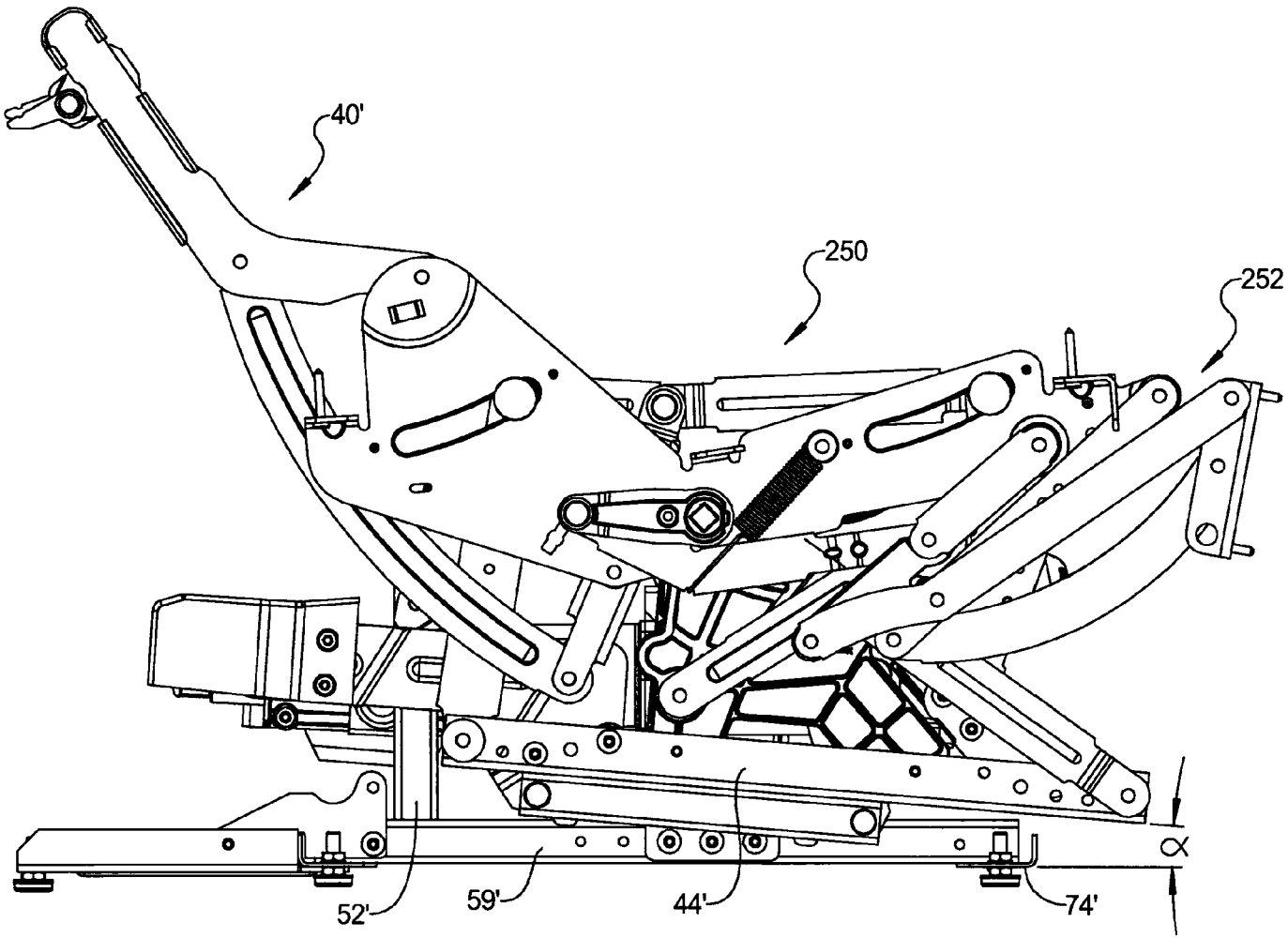
FIG. 23 is a right side elevational view of the mechanism of FIG. 22 in a forward glide position.

Referring to FIG. 23, actuation mechanism 250 is capable of both manual and automatic gliding motions from a neutral position (shown in FIG. 22) to a forward glide position having right side support member 44' defining an angle $\gamma$ with respect to front cross member 74'. With continuing reference to both FIGS. 23 and 17, angle $\gamma$ can be equal to or less than angle $\alpha$ previously described with respect to actuation mechanism 32. In the forward glide position shown, the seat back member, defined by the position of right side assembly 40', can be moved to the forward glide position with the seat back member in the fully upright position and the leg rest assembly 252 positioned in the stowed position.

Figure 24:
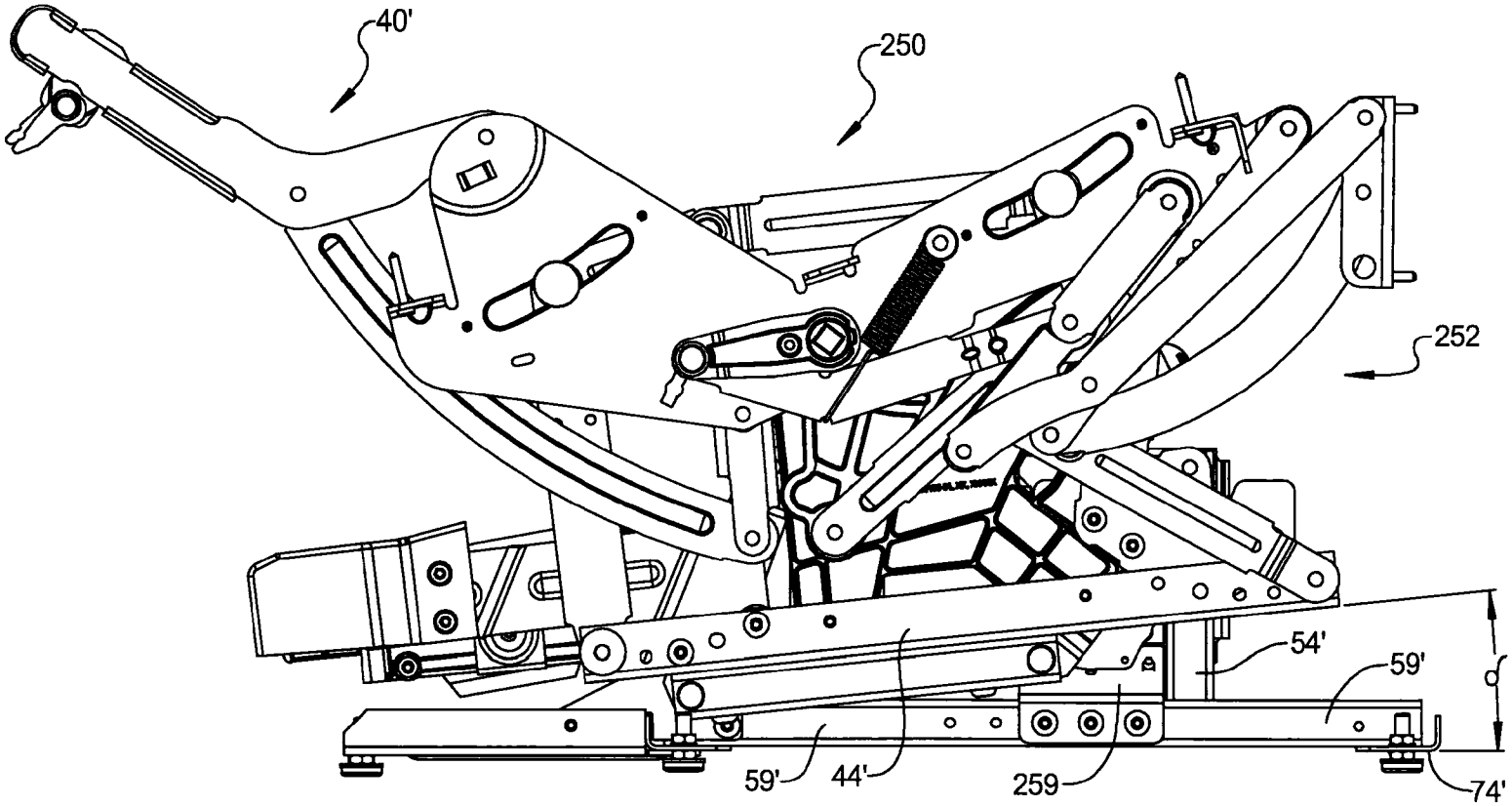
FIG. 24 is a right side elevational view of the mechanism of FIG. 22 in a rearward glide position.

Referring to FIG. 24 and again to FIG. 18, actuation mechanism 250 is shown in a rearward glide position having right side support member 44' oriented at an angle delta ($\Delta$) with respect to first cross member 74'. Angle delta ($\Delta$) can be equal to or less than angle beta ($\beta$) previously described with reference to actuation mechanism 32. According to several embodiments, actuation mechanism 250, having the leg rest assembly 252 in the stowed position, can also have the seat back member positioned in the fully reclined position, as shown with respect to right side assembly 40'. The fully reclined position for the seat back member can also be provided when actuation mechanism 250 is in the neutral or the forward glide position. A device mounting member 259 is connected to first longitudinal frame member 59' to releasably mount the components of powered glider drive device 258 (not clearly visible in this view).

Figure 25:
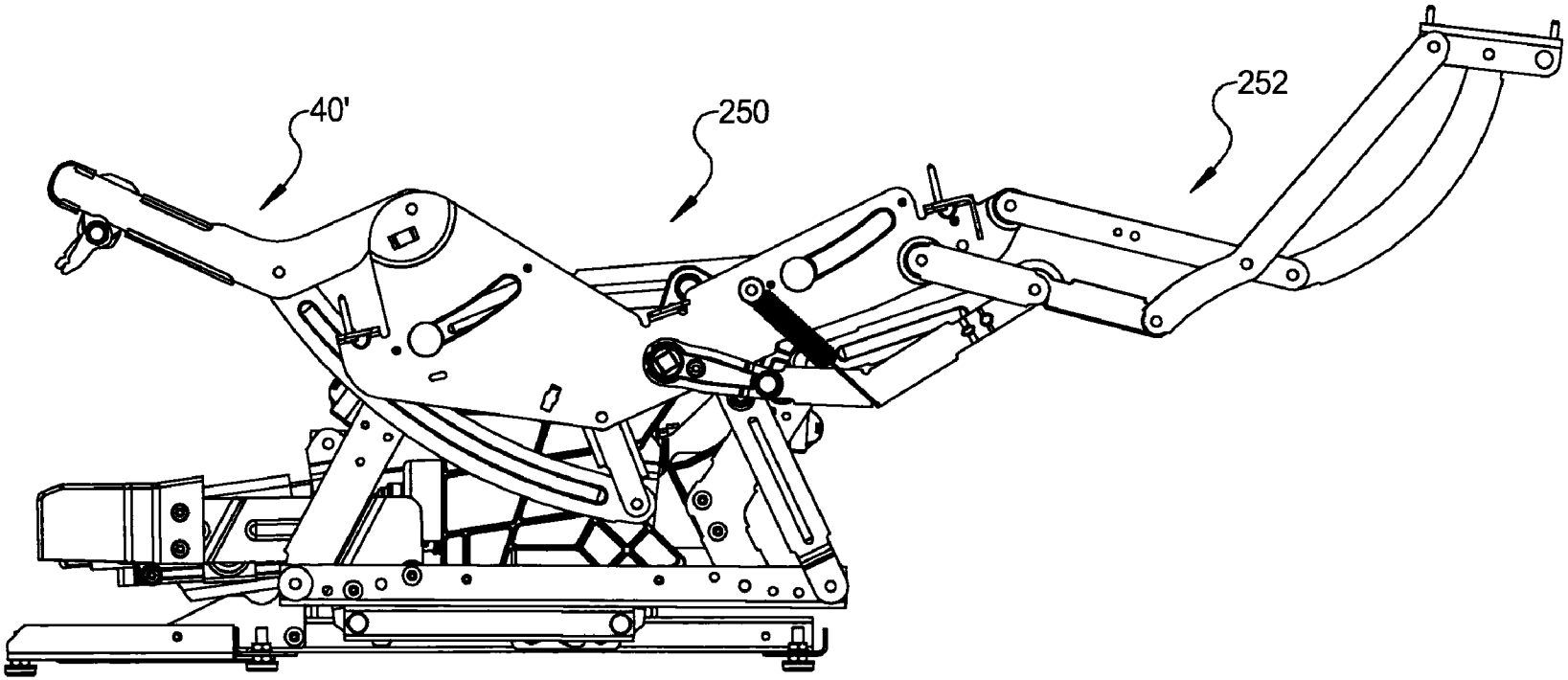
FIG. 25 is a right side elevational view of the mechanism of FIG. 22 in a neutral glide and legrest extended position.

Referring to FIG. 25, in the neutral glide position of actuation mechanism 250, the leg rest assembly 252 can also be positioned in the fully extended position shown. The seat back member can be positioned in the fully reclined position at the same time that the leg rest assembly 252 is positioned in the fully extended position. Actuation mechanism 250 can be displaced from the neutral position shown by powered actuation in either of the forward or rearward glide motions without changing the position of either the seat back member or the leg rest assembly 252.

Figure 26:
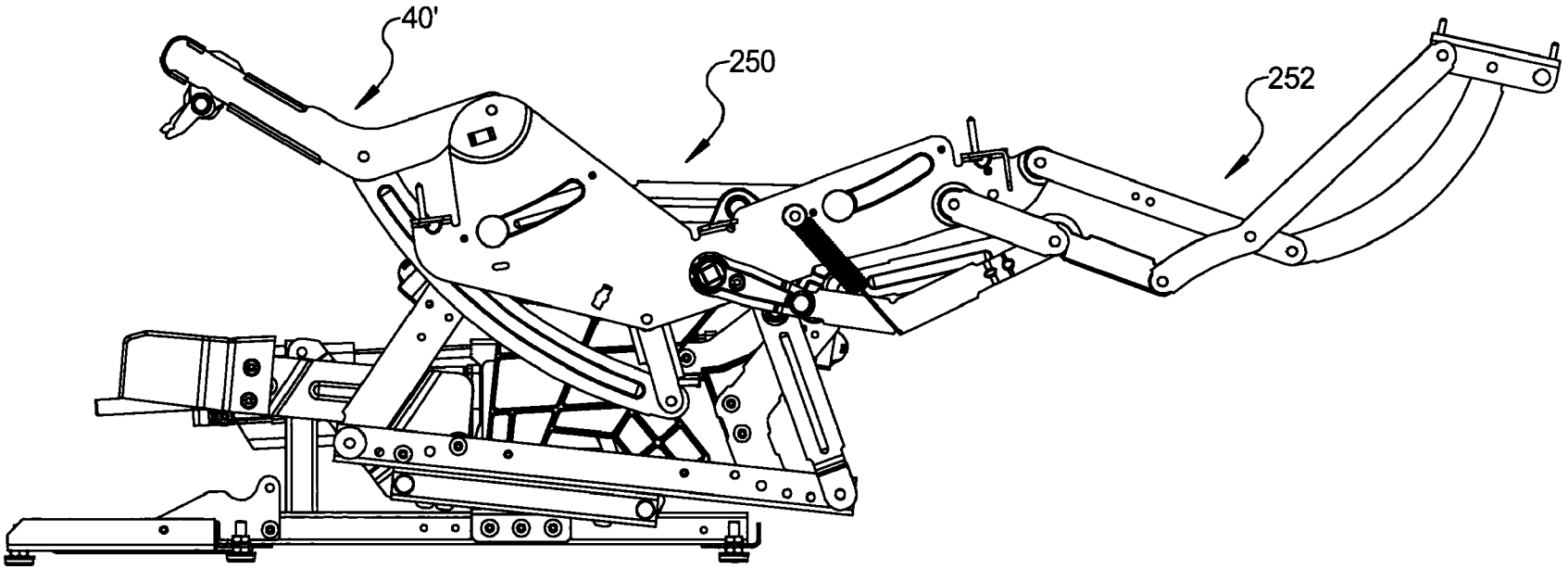
FIG. 26 is a right side elevational view of the mechanism of FIG. 25 in a forward glide and legrest extended position.

Referring to FIG. 26, actuation mechanism 250 has the right side assembly 40' positioned in the seat back fully reclined position and the leg rest assembly 252 positioned in the fully extended position. Full automatic glide of actuation mechanism 250 can occur in this or any seat back or leg rest assembly position of actuation mechanism 250.

Figure 27:
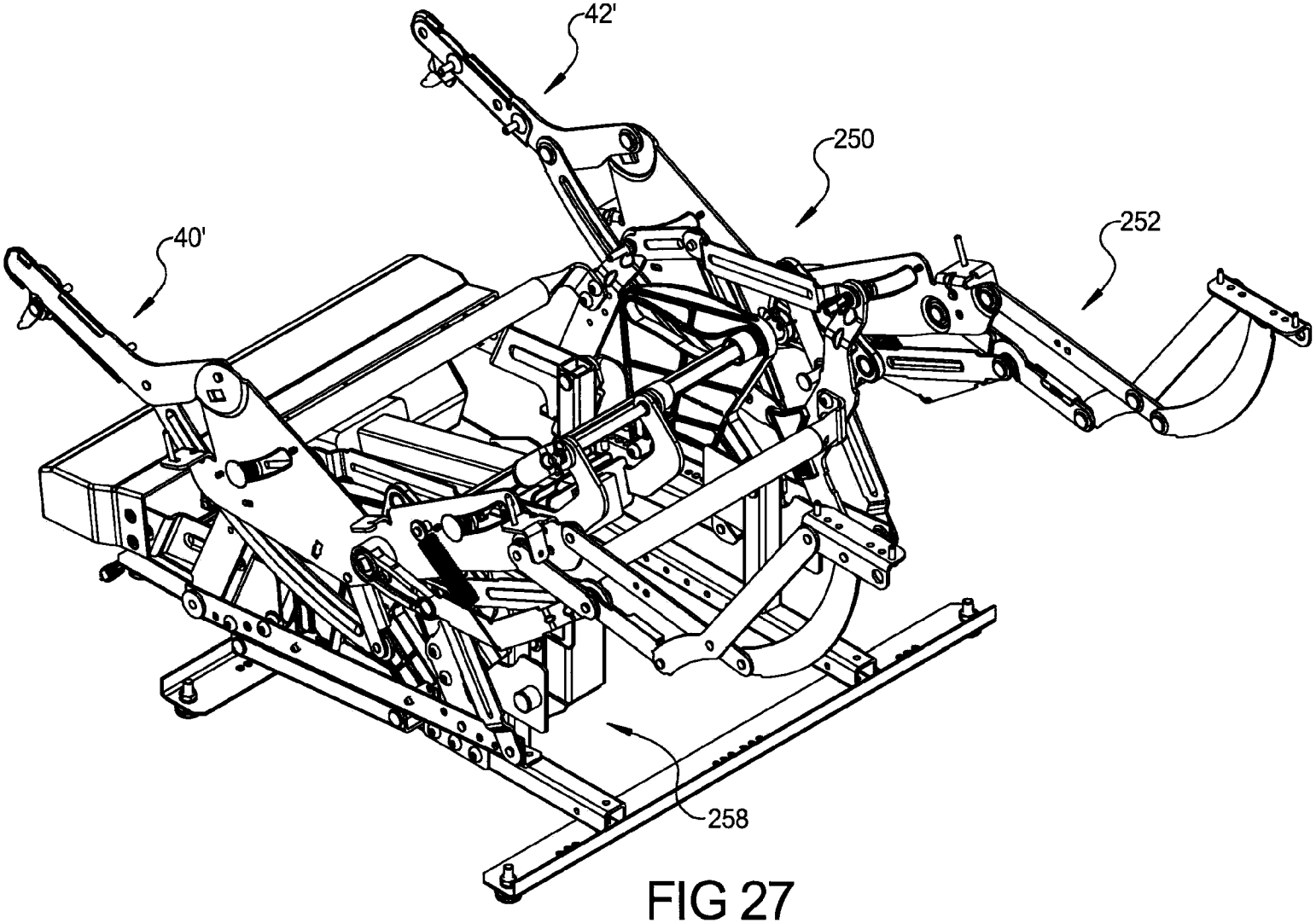
FIG. 27 is a right side elevational view of the mechanism of FIG. 25 in a rearward glide and legrest extended position.

Referring to FIG. 27, actuation mechanism 250 is shown after powered gliding motion to the rearward glide position. Actuation mechanism 250 is also shown having right and left side assemblies 40', 42' positioned in the seat back fully reclined position and leg rest assembly 252 in the fully extended position, which are not affected by the glide position of actuation mechanism 250. The automatic operation between any of the neutral, the forward, and the rearward glide positions of actuation mechanism 250 is provided by operation of powered glider drive device 258.

Figure 28:
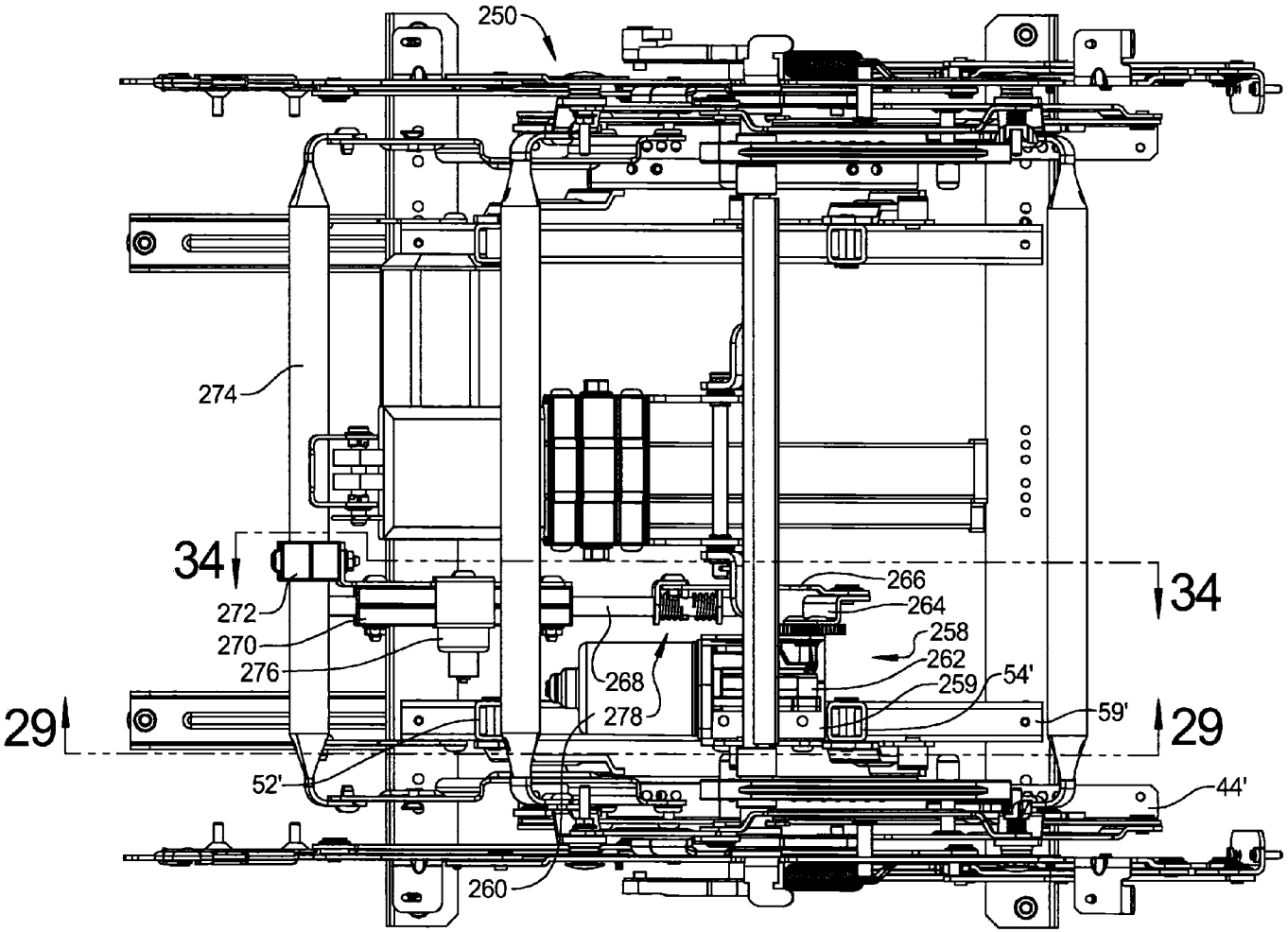
FIG. 28 is a top plan view of the mechanism of FIG. 22.

Referring to FIG. 28, several of the components of powered glider drive device 258 are fixedly connected to first longitudinal frame member 59' using device mounting member 259. These components include a gliding motion motor 260 which is connected to a source of electric power (not shown) such as a 110-volt AC outlet. Gliding motion motor 260 rotates to provide a driving force through a power transfer device 262 also fixedly connected to device mounting member 259. Gliding motion motor 260 and power transfer device 262 are fixedly connected to each other such that a rotating shaft of gliding motion motor 260 rotates components of power transfer device 262. According to several embodiments, gliding motion motor 260 and power transfer device 262 are positioned between first and second posts 52', 54'.

Powered operation of gliding motion motor 260 rotates components such as gears of power transfer device 262, which in turn rotate a connecting link 264. Connecting link 264 is rotatably connected to a drive link 266. Drive link 266 is rotatably connected to and imparts a substantially forward and backward reciprocating motion to a drive shaft 268. A block assembly 270 is slidably positioned on drive shaft 268 and is releasably connected to drive shaft 268 to permit manual gliding motion of actuation mechanism 250. When powered automatic operation of actuation mechanism 250 is desired, block assembly 270 is releasably, mechanically coupled to a drive bearing 272. Drive bearing 272 is in turn rotatably connected to a cross support member 274 which is connected to right and left side assemblies 40', 42'. By rotating connecting link 264, which is connected through drive link 266, drive shaft 268, block assembly 270 and drive bearing 272 to cross support member 274 therefore provides a front-to-back reciprocating motion of cross support member 274, thereby providing for automatic gliding motion of actuation mechanism 250. A shock absorber assembly 278 is used to connect drive link 266 to drive shaft 268. Shock absorber assembly 278 is provided to absorb the shock of coupling drive shaft 268 to drive bearing 272, which will be described in better detail in reference to FIG. 31.

Figure 29:
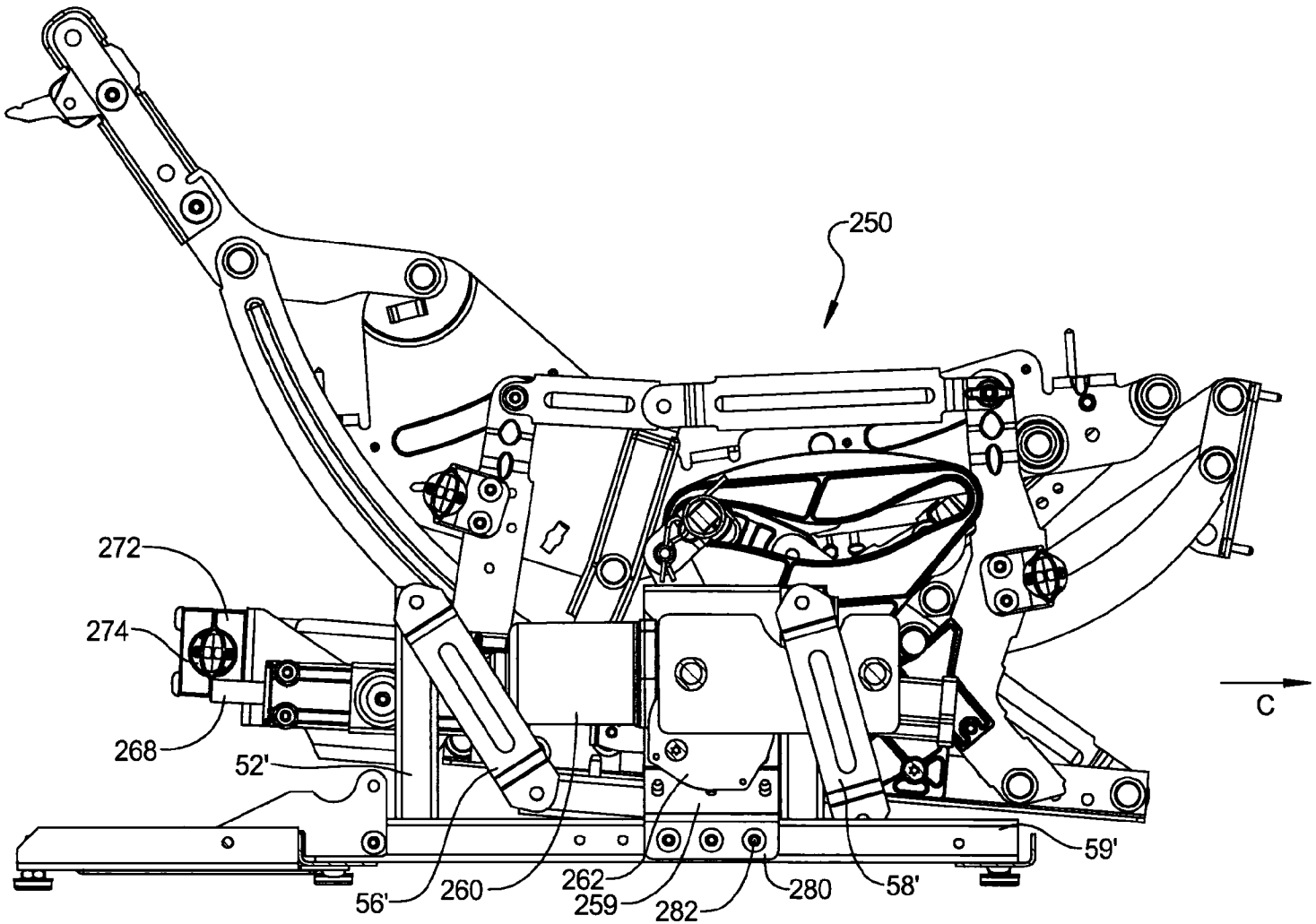
FIG. 29 is a partial cross sectional side elevational view taken at section 29 of FIG. 28.

Referring to FIG. 29, a mounting bracket 280 of device mounting member 259 is used to fixedly connect device mounting member 259 to first longitudinal frame member 59'. A plurality of fasteners 282 can be used for this purpose. In the forward glide position shown, drive bearing 272, coupled to drive shaft 268, pulls cross support member 274 in the forward direction "C". This rotates first glide link 56' with respect to first post 52' and also rotates second glide link 58' with respect to second post 54'. Automatic, powered gliding motion is provided by powered actuation of gliding motion motor 260 which transfers rotational force through power transfer device 262. Automatic powered gliding motion will continue as long as gliding motion motor 260 is energized. After gliding motion motor 260 is de-energized, actuation mechanism 250 returns, substantially by the force of gravity, to the neutral glide position shown in FIG. 22.

Figure 30:
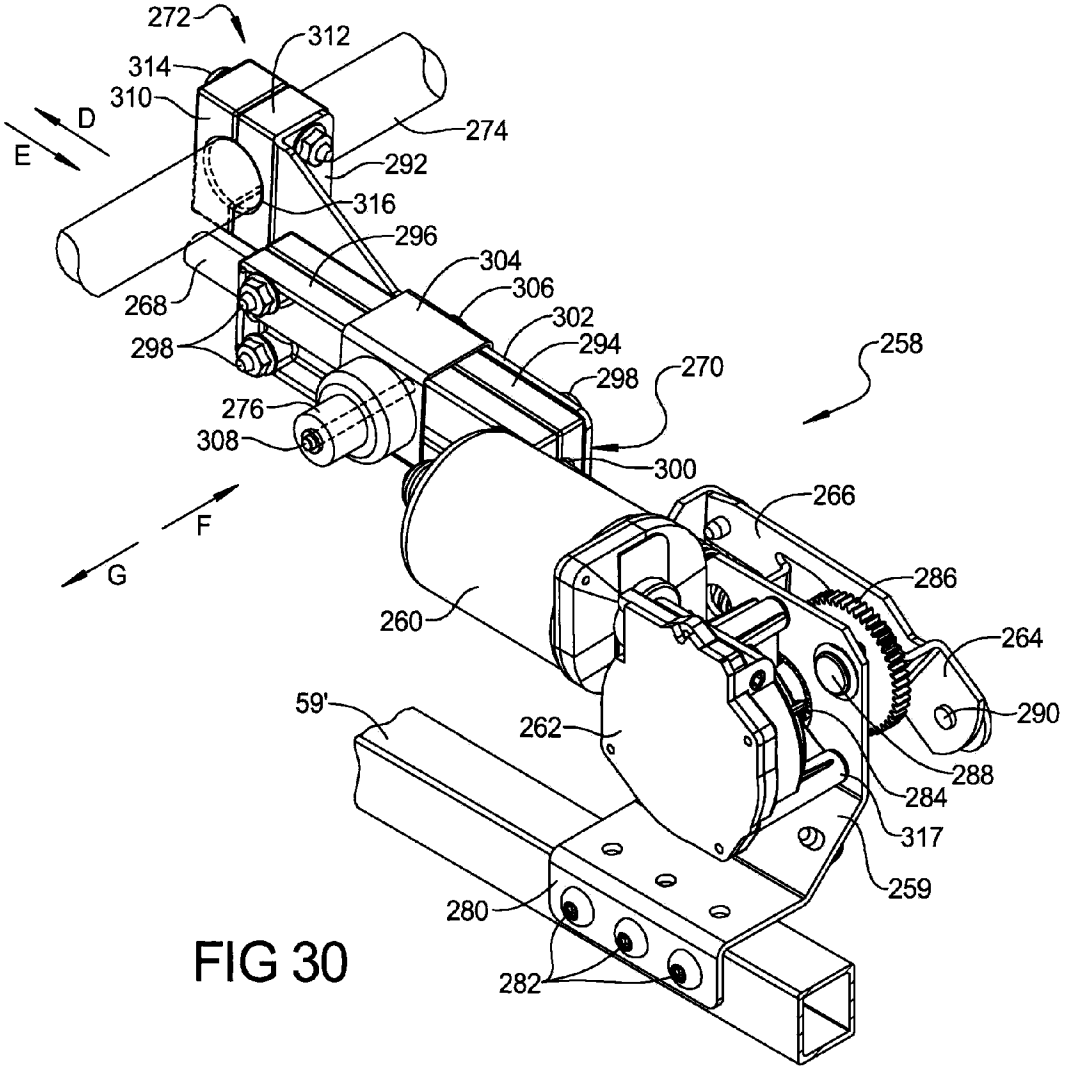
FIG. 30 is a right front perspective view of a gliding motion actuation device of the present disclosure.

Referring to FIG. 30, powered glider drive device 258 can further include a drive gear 284, which is directly rotated by operation of power transfer device 262. Drive gear 284 is in turn geared for rotation of a reduction gear 286. Reduction gear 286 is rotatably connected to device mounting member 259 using a rotational fastener 288. Reduction gear 286 is directly connected to connecting link 264 by rotational fastener 288 such that rotation of reduction gear 286 co-rotates connecting link 264. Connecting link 264 is rotatably connected to drive link 266 using a rotational fastener 290.

Drive bearing 272 is fixed with respect to block assembly 270 using a bearing mount bracket 292. Bearing mount bracket 292 is fastenably connected to a first block member 294 which is fastenably connected to a second block member 296 such that first and second block members 294, 296 are oppositely positioned with respect to drive shaft 268. Clearance is provided through the aperture defined between first and second block members 294, 296 such that drive shaft 268 can freely slide through block assembly 270 to permit manual gliding motion when powered glider drive device 258 is not energized. Fasteners 298 are used to fastenably connect each of bearing mount brackets 292 and first and second block members 294, 296. Each of the first and second block members 294, 296 include a semi-circular bore 300 which align with each other on opposite sides of drive shaft 268. Semi-circular bore 300 has a diameter larger than a diameter of drive shaft 268 to allow free sliding motion of drive shaft 268 with respect to block assembly 270.

A bracket leg 302 of bearing mount bracket 292 further supports a solenoid bracket 304 to which solenoid 276 is fixedly connected. Fasteners 306 are used to connect solenoid bracket 304 to bracket leg 302. Solenoid 276 is therefore maintained at a fixed positioned with respect to drive bearing 272. When solenoid 276 is de-energized, sliding motion of drive shaft 268 in either of a drive shaft extending direction "D" or a driveshaft retracting direction "E" can occur, permitting manual gliding motion of actuation mechanism 250. A pin 308, only partially visible in this view, is normally retracted away from engagement with drive shaft 268 when gliding motion motor 260 is non-operational or de-energized. Pin 308 is movable in each of a pin engagement direction "F" and a pin retraction direction "G". Pin 308 is moved in the pin engagement direction "F" when solenoid 276 is energized and is biased to move in the pin retraction direction "G" when solenoid 276 is de-energized.

Cross support member 274 is rotatably received through drive bearing 272. Drive bearing 272 includes each of a first bearing half 310 and a second bearing half 312 which are connected using bearing fasteners 314. Similar to first and second block members 294, 296, each of the first and second bearing halves 310, 312 include a semi-circular bore 316. A cross support member receiving diameter is created by semi-circular bores 316 when first and second bearing halves 310, 312 are joined together, which is larger than a diameter of cross support member 274. This diameter difference permits rotation of drive bearing 272 with respect to cross support member 274.

According to several embodiments, extension posts 317 can be provided with power transfer device 262 to mount power transfer device 262 and gliding motion motor 260 to device mounting member 259. A length of extension posts 317 is predetermined to align the gear teeth of drive gear 284 with the corresponding gear teeth of reduction gear 286.

Figure 31:
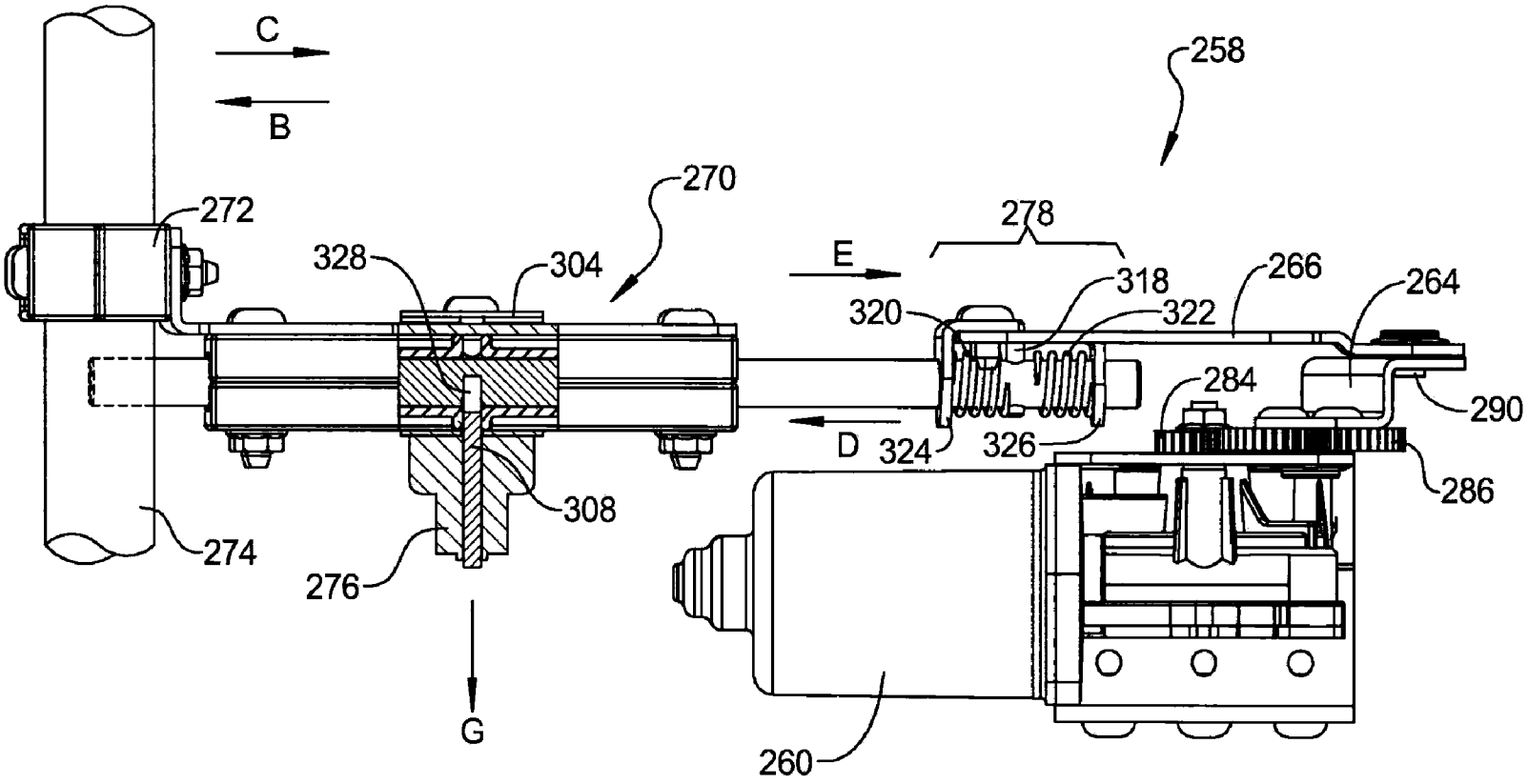
FIG. 31 is a top plan view of the device of FIG. 31.

Referring to FIG. 31, as previously noted cross support member 274 will move in each of the rearward direction "B" and the forward direction "C" during gliding motion of the actuation mechanism. Drive bearing 272, which is rotatably coupled to cross support member 274 as well as to block assembly 270, therefore move in unison with the motion of cross support member 274. This motion is permitted by a sliding motion of block assembly 270 with respect to drive shaft 268 during manual gliding motion of the actuation mechanism.

When powered gliding motion of the actuation mechanism is desired, gliding motion motor 260 and solenoid 276 are simultaneously energized. For powered gliding motion drive shaft 268 is releasably coupled to the block assembly 270. The drive force of gliding motion motor 260 is thereby transferred through drive shaft 268 using drive bearing 272 to displace cross support member 274. Because of the difference in masses involved, as well as the possibility that block assembly 270 may be in motion independent of the reciprocating motion of drive shaft 268 when gliding motion motor 260 is energized, the shock absorber assembly 278 is provided to couple drive link 266 to drive shaft 268. This is accomplished using an assembly retention pin 318 which is received through drive shaft 268 and extends outwardly from drive shaft 268 on opposite sides. A first biasing member 320 slidably displaced on drive shaft 268 is positioned on a first side of assembly retention pin 318 and a second biasing member 322 also slidably displaced on drive shaft 268 is positioned on an opposite side of assembly retention pin 318. A first retention member 324 retains first biasing member 320 such that first biasing member 320 elastically compresses between assembly retention pin 318 and first retention member 324 when drive shaft 268 is displaced in the drive shaft extending direction "D". A second retention member 326, extending from drive link 266, is provided to bound second biasing member 322 between assembly retention pin 318 and second retention member 326. Second biasing member 322 will elastically compress when drive shaft 268 moves in the drive shaft retraction direction "E". The compression of either first or second biasing members 320, 322 helps absorb the impact load when drive shaft 268 is coupled to drive bearing 272 using block assembly 270 and pin 308. According to several embodiments, first and second biasing members 320, 322 are provided as coiled compression springs having hollow center cavities slidably received over the diameter of drive shaft 268.

When solenoid 276 is de-energized, pin 308 is displaced away from, and therefore not engaged with drive shaft 268. At this time, pin 308 is spaced freely away from an aperture, bore or slot 328 created in drive shaft 268. This permits cross support member 274 to freely move in either of the rearward direction "B" or forward direction "C" by free sliding motion of block assembly 270 with respect to drive shaft 268. At the same time that solenoid 276 is de-energized, gliding motion motor 260 is also de-energized, permitting manual gliding motion of the actuation mechanism. There is no motion of reduction gear 286, connecting link 264, or drive link 266 when manual gliding motion is occurring.

Figure 32:
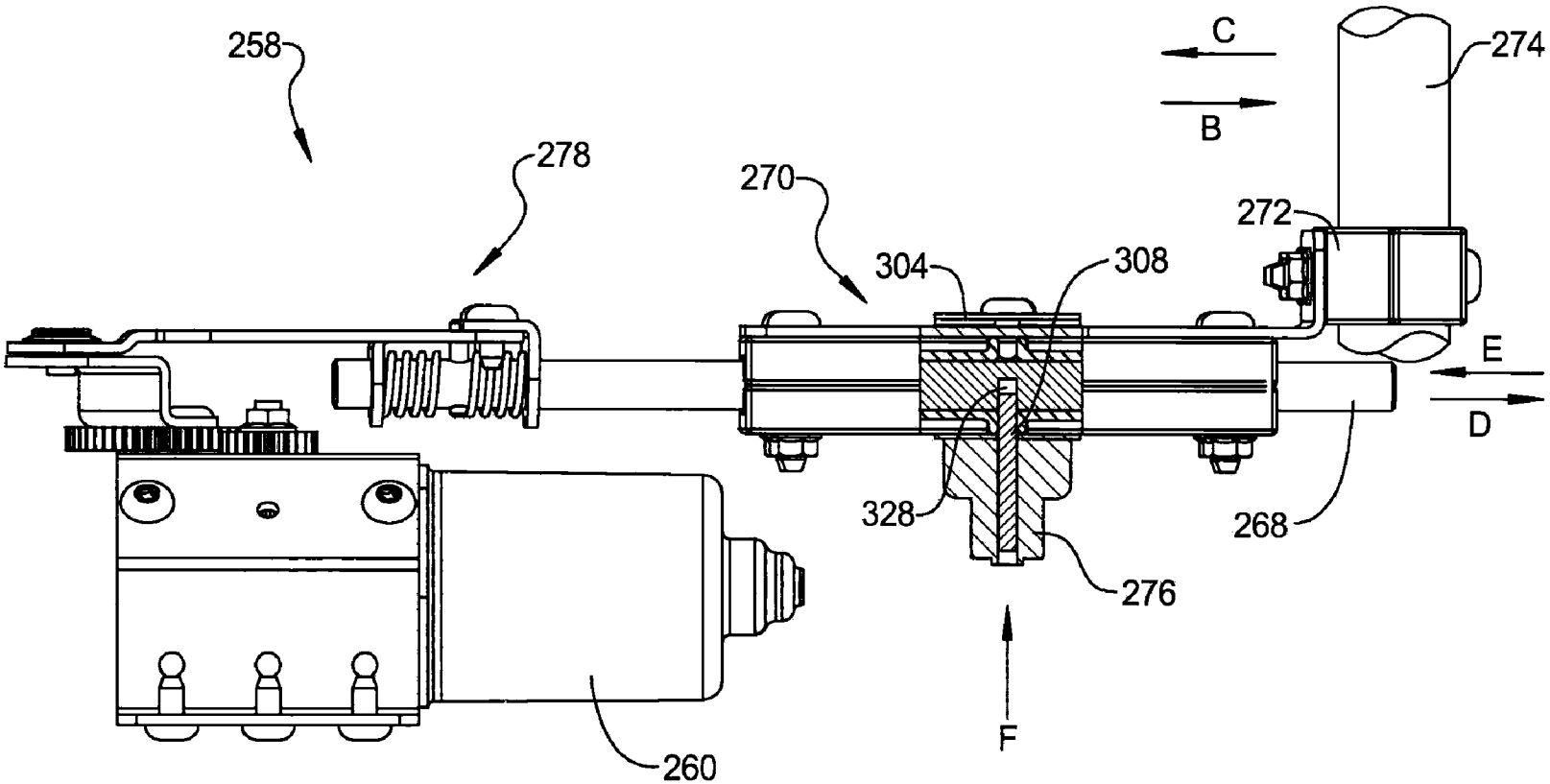
FIG. 32 is a bottom plan view of the device of FIG. 31.

Referring to FIG. 32, when automatic/powered gliding operation of powered glider drive device 258 is desired, both gliding motion motor 260 and solenoid 276 are simultaneously energized. When energized, solenoid 276 directs sliding displacement of pin 308 into sliding engagement with slot 328 of drive shaft 268. This transfers a drive shaft reciprocating motion in either of the drive shaft extending direction "D" or drive shaft retracting direction "E" of drive shaft 268 to cross support member 274. Because slot 328 may not initially be in direct axial alignment to receive pin 308, the shock absorber assembly 278 is provided such that when pin 308 engages slot 328, a coupling force or abrupt acceleration is partially absorbed by first and second biasing members 320, 322 and therefore not directly transferred through to the occupant of the furniture member.

When pin 308 engages slot 328, drive shaft 268 is coupled to drive bearing 272 for powered displacement of cross support member 274 in both of the rearward direction "B" and forward direction "C" as a reciprocating motion. As long as solenoid 276 is energized, an extending force is provided by solenoid 276 to extend pin 308 in the pin engagement direction "F" to maintain the releasable coupling between drive shaft 268 and cross support member 274. Immediately when solenoid 276 is de-energized, pin 308 retracts out of slot 328 and subsequently retracts away from slot 328, thereby ceasing the automatic powered gliding motion of the actuation mechanism by powered glider drive device 258.

Figure 33:
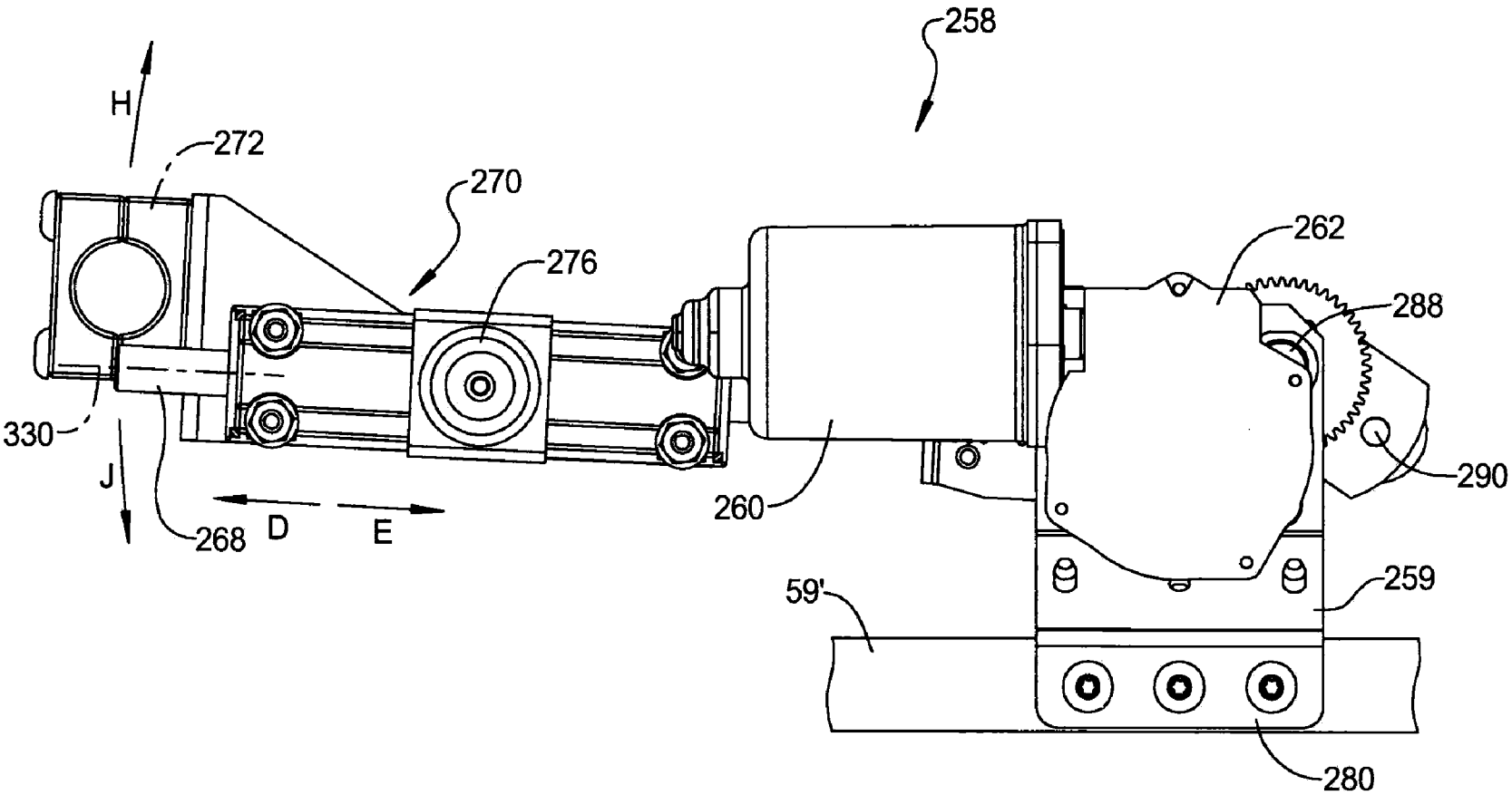
FIG. 33 is a side elevational view of the device of FIG. 31.

Referring to FIG. 33, as previously noted, both the position and orientation of gliding motion motor 260 and power transfer device 262 are fixed with respect to first longitudinal frame member 59'. Because the center of rotation of rotational fastener 288 is offset with respect to the center of rotation of rotational fastener 290, a longitudinal axis 330 of drive shaft 268 can angularly change in addition to the front-to-back reciprocating motion during powered automatic gliding operation. This can manifest itself in upward and downward motions of the drive bearing 272 in either an upward arc of rotation "H" or a downward arc of rotation "J" with respect to the orientation of longitudinal axis 330 which is shown in the neutral gliding position of power glider drive device 258.

Figure 34:
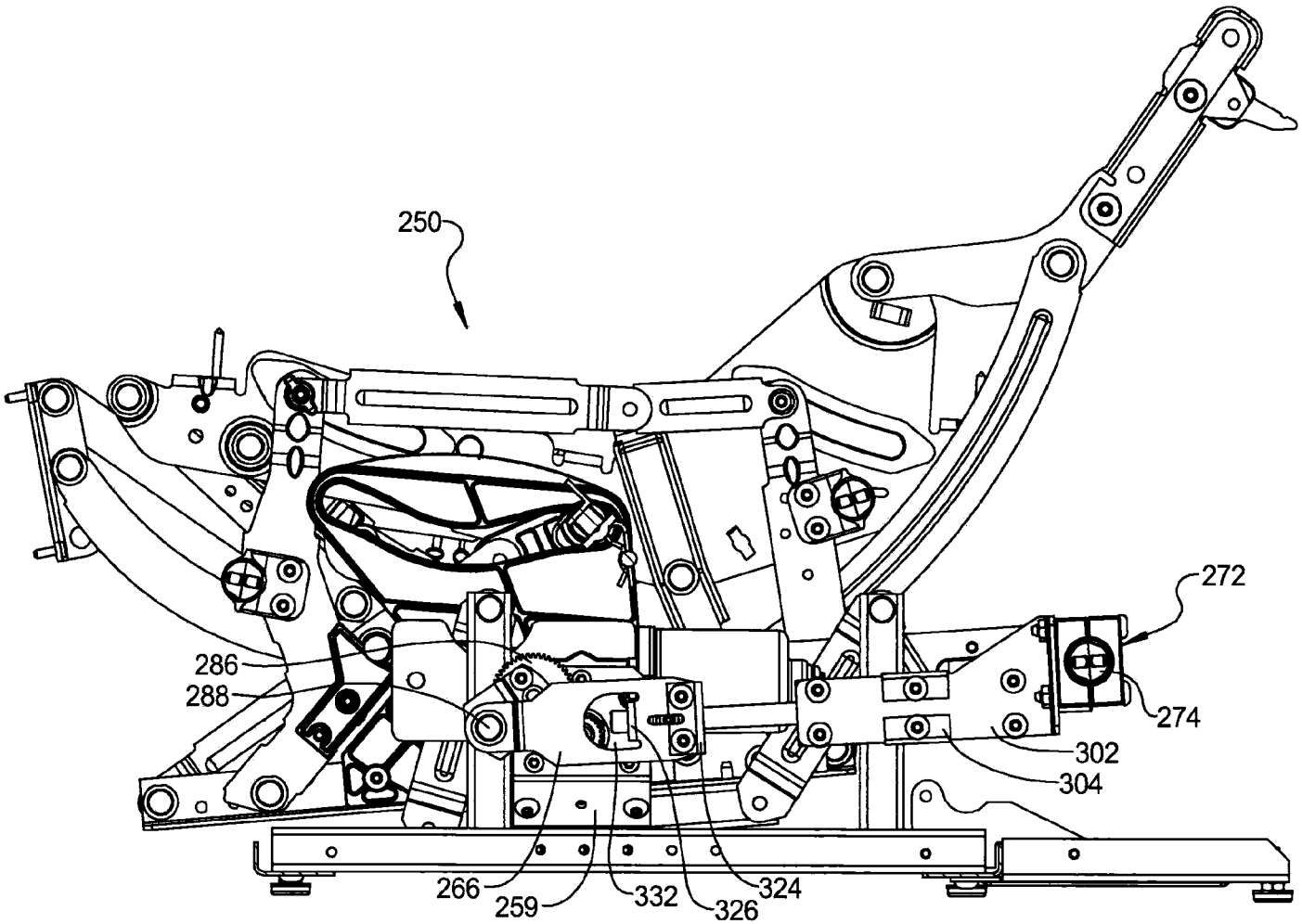
FIG. 34 is a partial cross sectional side elevational view taken at section 34 of FIG. 28.

Referring to FIG. 34, according to several embodiments, second retention member 326 can be formed by a punching, piecing or similar operation on drive link 266 such that second retention member 326 is bent or formed at an angle with respect to drive link 266 thereby forming a cavity 332 in drive link 266 which provides access for a fastener. According to several embodiments, first retention member 324 is fastenably connected to drive link 266. Rotational fastener 288 is therefore oriented to provide an off-center drive force with respect to a longitudinal axis of cross support member 274.

Figure 35:
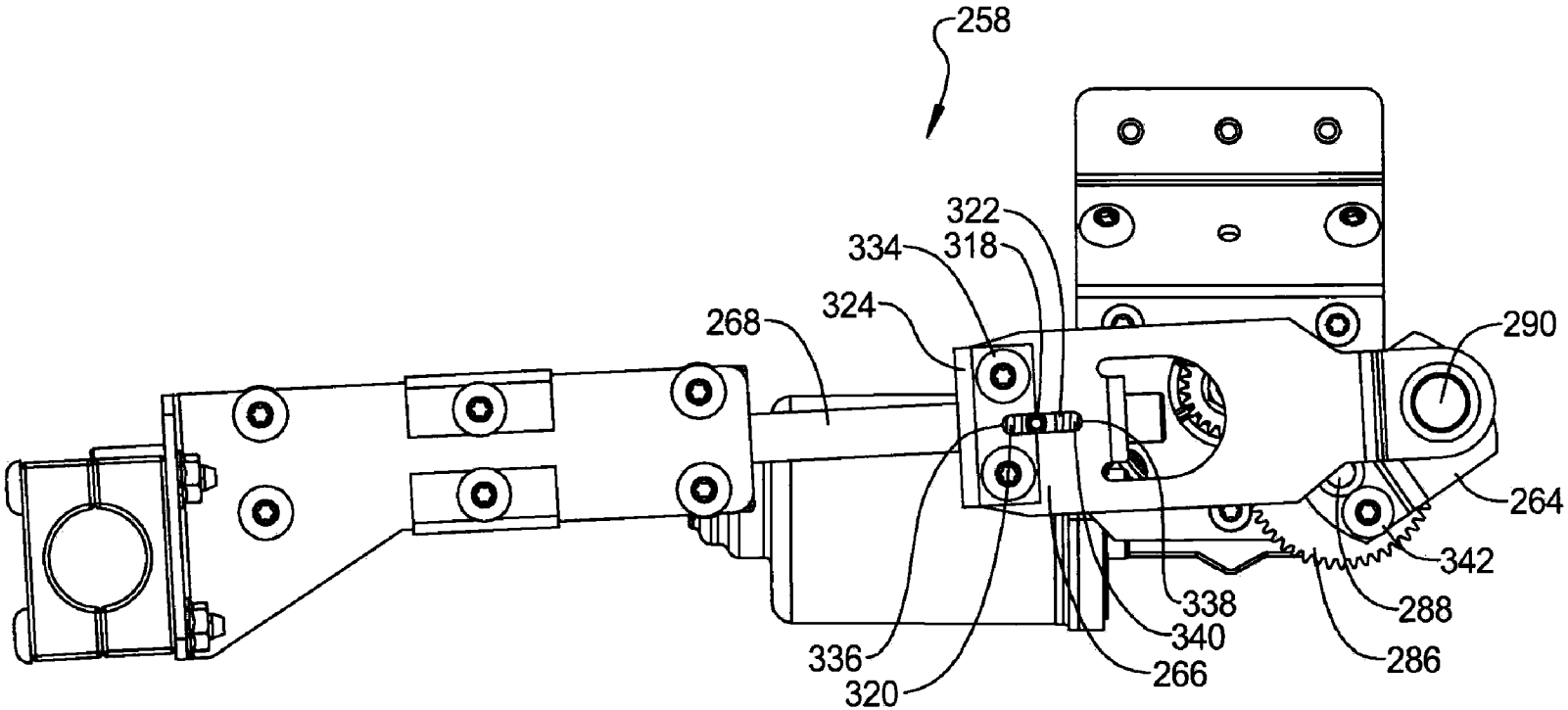
FIG. 35 is a side elevational view of the powered glider drive device of FIG. 34.

Referring to FIG. 35, one or more fasteners 334 such as rivets can be used to fix first retention member 324 onto drive link 266. Opposed first and second end walls 336, 338 of an elongated pin travel slot 340 create positive stops for sliding travel of assembly retention pin 318 which is partially received in pin travel slot 340. Pin travel slot 340 can also extend partially through first retention member 324 as necessary. Opposed first and second end walls 336, 338 prevent over-compression of first and second biasing members 320, 322 as drive shaft 268 axially displaces during automatic powered operation of powered glider drive device 258. At least one fastener 342 such as a bolt or rivet is used to fix connecting link 264 onto reduction gear 286 such that axial rotation of reduction gear 286 with respect to rotational fastener 288 co-rotates connecting link 264.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A furniture member having a powered gliding motion, comprising:

a frame;

an actuation mechanism movably connected to the frame permitting actuation mechanism forward and rearward gliding motions; and a powered glider drive device including a gliding motion motor connected to the frame and operating a power transfer device, the powered glider drive device when energized is releasably engaged to both the actuation mechanism and the frame to automatically induce the forward and rearward gliding motions of the actuation mechanism;

a drive shaft connected to the gliding motion motor and movable in reciprocating forward and rearward directions by operation of the motor;

a solenoid acting as a drive shaft engagement device; and a pin movable by the solenoid to releasably engage a slot created in the drive shaft.

2. The furniture member of claim 1, further including:

a cross support member connected to first and second longitudinal frame members of the actuation mechanism; and a drive bearing releasably coupled to the drive shaft and rotatably connected to the cross support member such that movement of the drive shaft in the forward and rearward directions when the drive bearing is coupled to the drive shaft successively moves the actuation mechanism in the forward and rearward gliding motions.

3. The furniture member of claim 2, further including a drive shaft engagement device having a block assembly slidably disposed on the drive shaft, the block assembly connected to the drive bearing.

4. The furniture member of claim 3, wherein the drive shaft engagement device further includes:

the solenoid mounted to the block assembly, the solenoid simultaneously energized when the motor is energized and de-energized when the motor is de-energized; and a pin movable by the solenoid when the solenoid is energized to engage a slot created in the drive shaft to releasably engage the drive shaft engagement device to the drive shaft thereby releasably engaging the drive shaft to the drive bearing, which thereby releasably engages the actuation mechanism to the frame.

5. The furniture member of claim 4, wherein when the solenoid is de-energized the pin is at a disengaged position displaced away from the slot, and the block assembly is freely slidable on the drive shaft to permit an occupant to manually propel the actuation mechanism in the forward and rearward gliding motions.

6. The furniture member of claim 1, further including:

a drive gear of the drive device connected to the motor, the drive gear engaged to a reduction gear;

a connecting link directly connected to the reduction gear; and a drive link connecting the connecting link to the drive shaft.

7. The furniture member of claim 6, further including:

a connecting pin received through the drive shaft; and a shock absorber assembly having a first biasing member slidably disposed on the drive shaft and a first flange slidably receiving the drive shaft, the first biasing member positioned between the connecting pin and the first flange and elastically compressed when the drive shaft moves in the forward direction.

8. The furniture member of claim 7, further including:

a second flange connected to the drive link and slidably receiving the drive shaft, the second flange oppositely positioned about the connecting pin with respect to the first flange; and a second biasing member slidably received on the drive shaft between the second flange and the connecting pin, the second biasing member elastically compressed when the drive shaft moves in the rearward direction.

9. The furniture member of claim 1, further including a shock absorber assembly having first and second biasing members slidably disposed on the drive shaft and oppositely positioned about a connecting pin, the first biasing member elastically compressed when the drive shaft moves in the forward direction and the second biasing member elastically compressed when the drive shaft moves in the rearward direction.

10. The furniture member of claim 1, further including a plurality of posts fixedly connected to the frame and extending upwardly therefrom, the actuation mechanism rotatably suspended from pins received at an upper end of individual ones of the plurality of posts.

11. The furniture member of claim 10, further including:

a plurality of links individually rotatably connected to one of the pins received in the upper end of the individual ones of the plurality of posts;

wherein the actuation mechanism is rotatably connected to a lower end of individual ones of the plurality of links.

12. The furniture member of claim 1, wherein the frame further includes a longitudinal frame member, the powered glider drive device being fixedly connected to the longitudinal frame member.

13. The furniture member of claim 1, further including:

a leg rest assembly connected to the actuation mechanism and displaceable between a stowed position and a fully extended position; and a seat back member connected to the actuation mechanism and displaceable between a fully upright position and a fully reclined position;

wherein the forward and rearward gliding motions are available when any of a) the leg rest assembly is in the stowed position and the seat back member is in the fully upright position, b) the leg rest assembly is in the fully extended position and the seat back member in the fully upright position, or c) the leg rest assembly is in the fully extended position and the seat back member is in the fully reclined position.

14. A furniture member having a powered gliding motion, comprising:

a frame;

an actuation mechanism movably connected to the frame permitting forward and rearward gliding motions of the actuation mechanism with respect to the frame;

a powered glider drive device, having:

a gliding motion motor connected to the frame;

a drive shaft movable in reciprocating forward and rearward directions by operation of the gliding motion motor;

a solenoid energized when the gliding motion motor is energized and de-energized when the gliding motion motor is de-energized; and a pin movable by the solenoid to releasably engage a slot created in the drive shaft to use the reciprocating forward and rearward direction movement of the drive shaft to automatically induce the forward and rearward gliding motions of the actuation mechanism.

15. The furniture member of claim 14, wherein the pin is biased to retract from the slot when the solenoid is de-energized.

16. The furniture member of claim 14, wherein the powered glider drive device further includes:

a power transfer device connected to the gliding motion motor; and at least one link rotatably connecting the power transfer device to the drive shaft to transfer a rotational motion of the power transfer device to the reciprocating forward and the rearward direction movements of the drive shaft.

17. The furniture member of claim 14, further including a shock absorber assembly having at least one biasing member slidably disposed on the drive shaft and compressible against a connecting pin connected to the drive shaft, the at least one biasing member elastically compressed when the drive shaft moves in one of the forward or rearward directions.

18. The furniture member of claim 14, further including:

a block assembly slidably positioned on the drive shaft having the solenoid mounted to the block assembly;

a cross support member fixedly connected to first and second longitudinal frame members of the actuation mechanism; and a drive bearing connected to the block assembly and rotatably connected to the cross support member such that movement of the drive shaft in the forward and rearward directions when the drive bearing is engaged to the drive shaft by the pin being releasably engaged in the slot of the drive shaft successively moves the actuation mechanism in the forward and rearward gliding motions.

19. A furniture member having a powered gliding motion, comprising:

a frame;

an actuation mechanism movably connected to the frame permitting forward and rearward gliding motions of the actuation mechanism;

a powered glider drive device selectively connected to both the frame and the actuation mechanism having a gliding motion motor operating a power transfer device to automatically move the actuation mechanism in the forward and rearward gliding motions;

a drive shaft connected to the power transfer device and movable in reciprocating forward and rearward directions by operation of the gliding motion motor;

the powered glider drive device further including:

a solenoid; and a pin movable when the solenoid is energized to releasably engage a slot created in the drive shaft to selectively movably engage the actuation mechanism to the frame; and the actuation mechanism further including:

a leg rest assembly;

a seat back member; and an electrically powered drive assembly operating to rotate the leg rest assembly and the seat back member independently of the forward and rearward gliding motions.

20. The furniture member of claim 19, wherein an occupant induced force operates to manually move the actuation mechanism in the forward and rearward gliding motions when the gliding motion motor and the solenoid are both de-energized and the pin is retracted from the slot.

* * * * *